US010917708B2

(12) United States Patent
Won et al.

(10) Patent No.: US 10,917,708 B2
(45) Date of Patent: Feb. 9, 2021

(54) DISPLAY DEVICE

(71) Applicant: Samsung Display Co., Ltd., Yongin-si (KR)

(72) Inventors: Byeong Hee Won, Incheon (KR); Jae Been Lee, Seoul (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 16/813,262

(22) Filed: Mar. 9, 2020

(65) Prior Publication Data

US 2020/0359119 A1 Nov. 12, 2020

(30) Foreign Application Priority Data

May 10, 2019 (KR) ..... 10-2019-0055032

(51) Int. Cl.

| | |
|---|---|
| ***H04R 1/02*** | (2006.01) |
| ***H04R 9/02*** | (2006.01) |
| ***H04R 9/06*** | (2006.01) |
| ***H04R 7/04*** | (2006.01) |
| ***H04R 17/00*** | (2006.01) |
| ***H04R 9/04*** | (2006.01) |
| ***H04R 7/26*** | (2006.01) |

(52) U.S. Cl.

CPC ..... *H04R 1/028* (2013.01); *H04R 7/04* (2013.01); *H04R 7/26* (2013.01); *H04R 9/022* (2013.01); *H04R 9/046* (2013.01); *H04R 9/06* (2013.01); *H04R 17/00* (2013.01); *H04R 2400/03* (2013.01); *H04R 2400/11* (2013.01); *H04R 2499/15* (2013.01)

(58) Field of Classification Search

None

See application file for complete search history.

(56) References Cited

U.S. PATENT DOCUMENTS

| | | | | |
|---|---|---|---|---|
| 2018/0317000 | A1* | 11/2018 | Ham | H04R 9/06 |
| 2019/0037164 | A1* | 1/2019 | Kim | H04R 1/2873 |
| 2019/0045287 | A1* | 2/2019 | Lee | G06F 1/1605 |
| 2019/0341433 | A1* | 11/2019 | Im | H01L 51/0097 |

FOREIGN PATENT DOCUMENTS

| | | |
|---|---|---|
| JP | 1169474 | 3/1999 |
| JP | 2007259024 | 10/2007 |
| JP | 2018129686 | 8/2018 |
| KR | 1020060050022 | 5/2006 |

* cited by examiner

*Primary Examiner* — Paul W Huber

(74) *Attorney, Agent, or Firm* — Cantor Colburn LLP

(57) ABSTRACT

A display device includes a display panel which includes a first substrate and a light emitting element layer disposed on a first surface of the first substrate; a lower cover disposed on a second surface of the first substrate; a first sound generator disposed on the second surface of the first substrate, where the first sound generator outputs a first sound by vibrating the display panel using a magnetic force generated through a voice coil therein; and a second sound generator disposed on the second surface of the first substrate, where the second sound generator outputs a second sound corresponding to a pressure change in a space between the display panel and the lower cover caused by a vibration of the display panel.

20 Claims, 23 Drawing Sheets

DISPLAY DEVICE

This application claims priority to Korean Patent Application No. 10-2019-0055032, filed on May 10, 2019, and all the benefits accruing therefrom under 35 U.S.C. § 119, the content of which in its entirety is herein incorporated by reference.

BACKGROUND

1. Field

The disclosure relates to a display device.

2. Description of the Related Art

As the information society develops, the demand for display devices for displaying images is increasing and diversified. For example, display devices are being applied to various electronic devices such as smartphones, digital cameras, notebook computers, navigation devices, and smart televisions. The display devices may be flat panel display devices such as liquid crystal display devices, field emission display devices, and organic light emitting display devices. A display device may include a display panel for displaying an image and a speaker for providing sound.

SUMMARY

Embodiments of the disclosure provide a display device capable of improving sound quality by outputting sound forward by vibrating a display panel using a sound generator.

Embodiments of the disclosure also provide a display device capable of improving sound quality by further including a low-frequency sound generator.

An embodiment of a display device includes: a display panel which includes a first substrate and a light emitting element layer disposed on a first surface of the first substrate; a lower cover disposed on a second surface of the first substrate; a first sound generator disposed on the second surface of the first substrate, where the first sound generator outputs a first sound by vibrating the display panel using a magnetic force generated through a voice coil therein; and a second sound generator disposed on the second surface of the first substrate, where the second sound generator outputs a second sound corresponding to a pressure change in a space between the display panel and the lower cover caused by a vibration of the display panel.

BRIEF DESCRIPTION OF THE DRAWINGS

These and/or other features of the invention will become apparent and more readily appreciated from the following description of embodiments, taken in conjunction with the accompanying drawings, in which.

DETAILED DESCRIPTION

Figure 1:
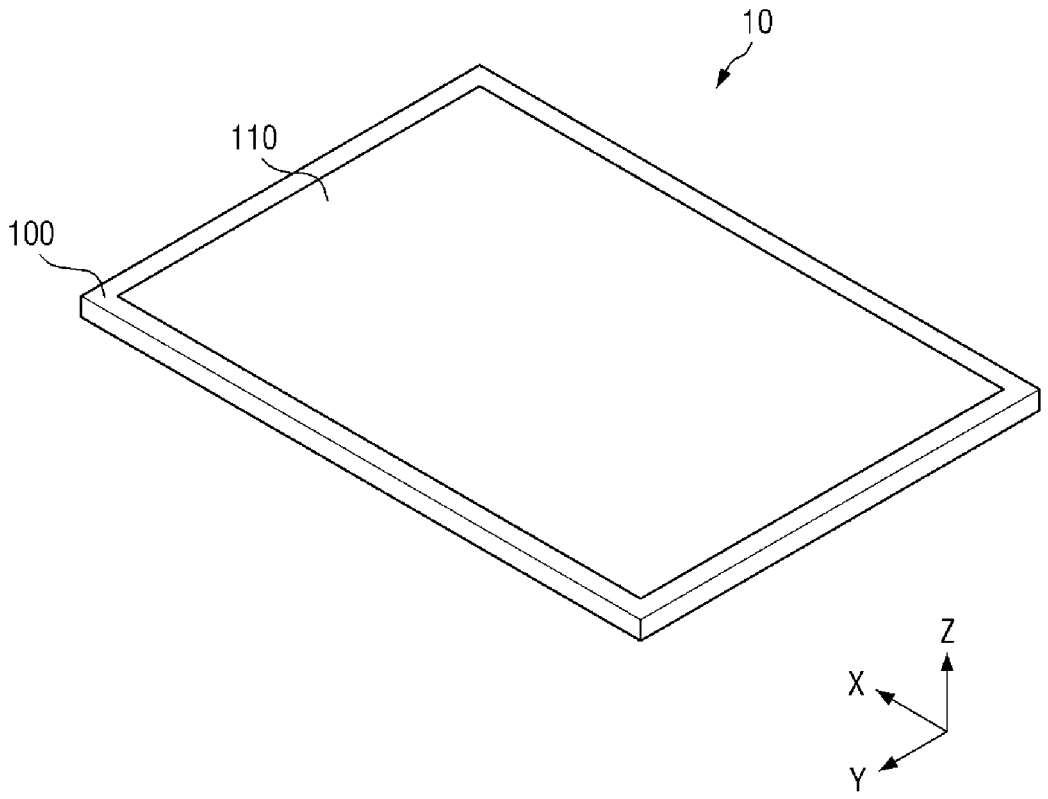
FIG. 1 is a perspective view of a display device according to an embodiment.

Features of the inventive concept and methods of accomplishing the same may be understood more readily by reference to the following detailed description of embodiments and the accompanying drawings. The invention may, however, be embodied in many different forms and should not be construed as being limited to the embodiments set forth herein. Rather, these embodiments are provided so that this disclosure will be thorough and complete and will fully convey the concept of the invention to those skilled in the art, and the invention will only be defined by the appended claims. Like reference numerals refer to like elements throughout the specification.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." "At least one of A and B" means "A and/or B." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Respective features of embodiments of the disclosure may be partially or entirely joined or combined with each other, and technically various linkages and driving may be possible. The embodiments may be implemented independently or in association with each other.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described with reference to the accompanying drawings.

Hereinafter, for convenience of description, embodiments where a display device 10 is an organic light emitting display device using organic light emitting elements as light emitting elements will be described in detail, but embodiments of the invention are not limited there. In alternative embodiments, the display device 10 may also be an inorganic light emitting display device using micro-light emitting diodes, nano light emitting diodes, quantum-dot light emitting diodes, or other inorganic semiconductors (inorganic light emitting diodes) as light emitting elements.

Figure 2:
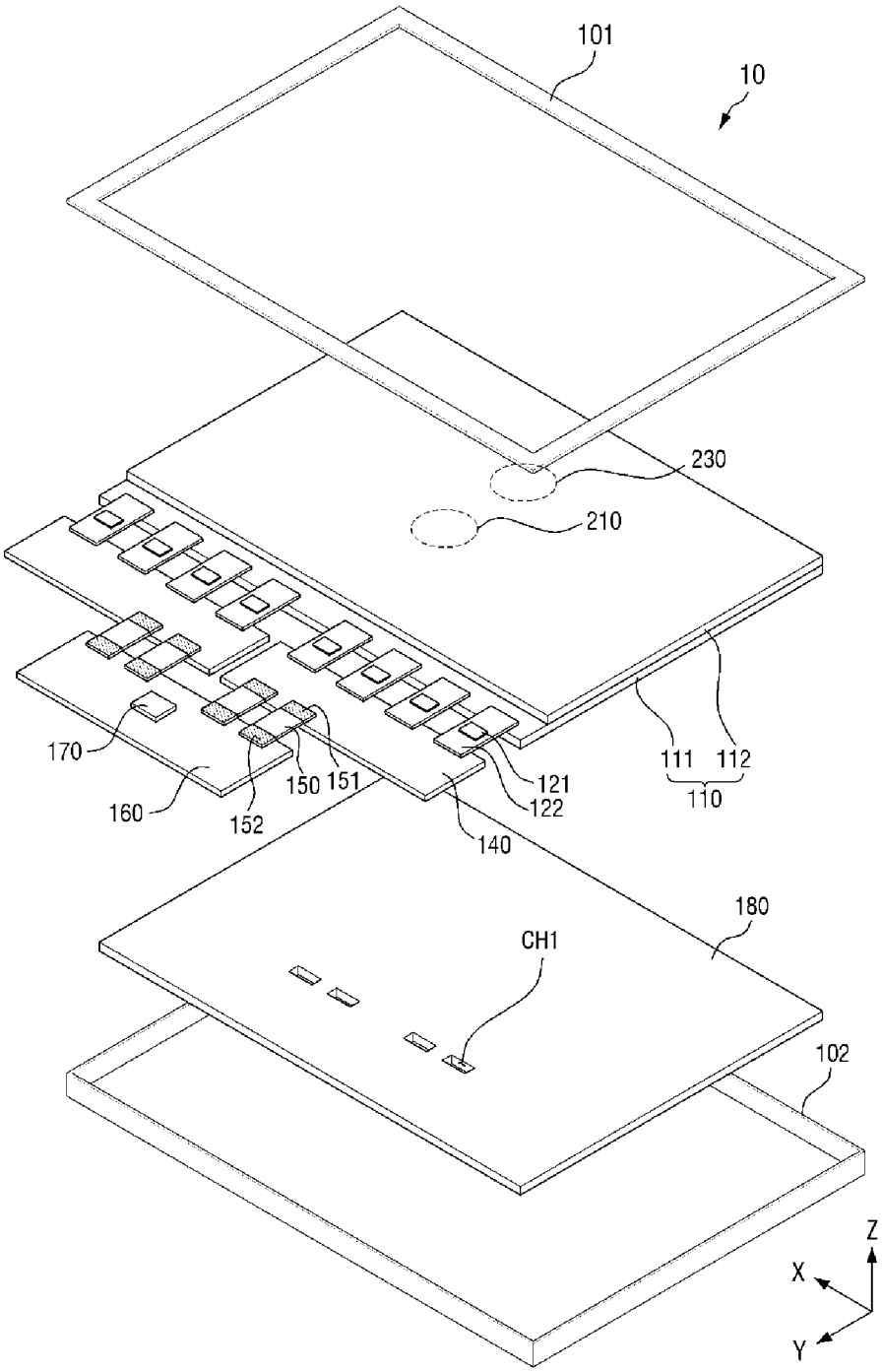
FIG. 2 is an exploded perspective view of the display device according to an embodiment.
Figure 3:
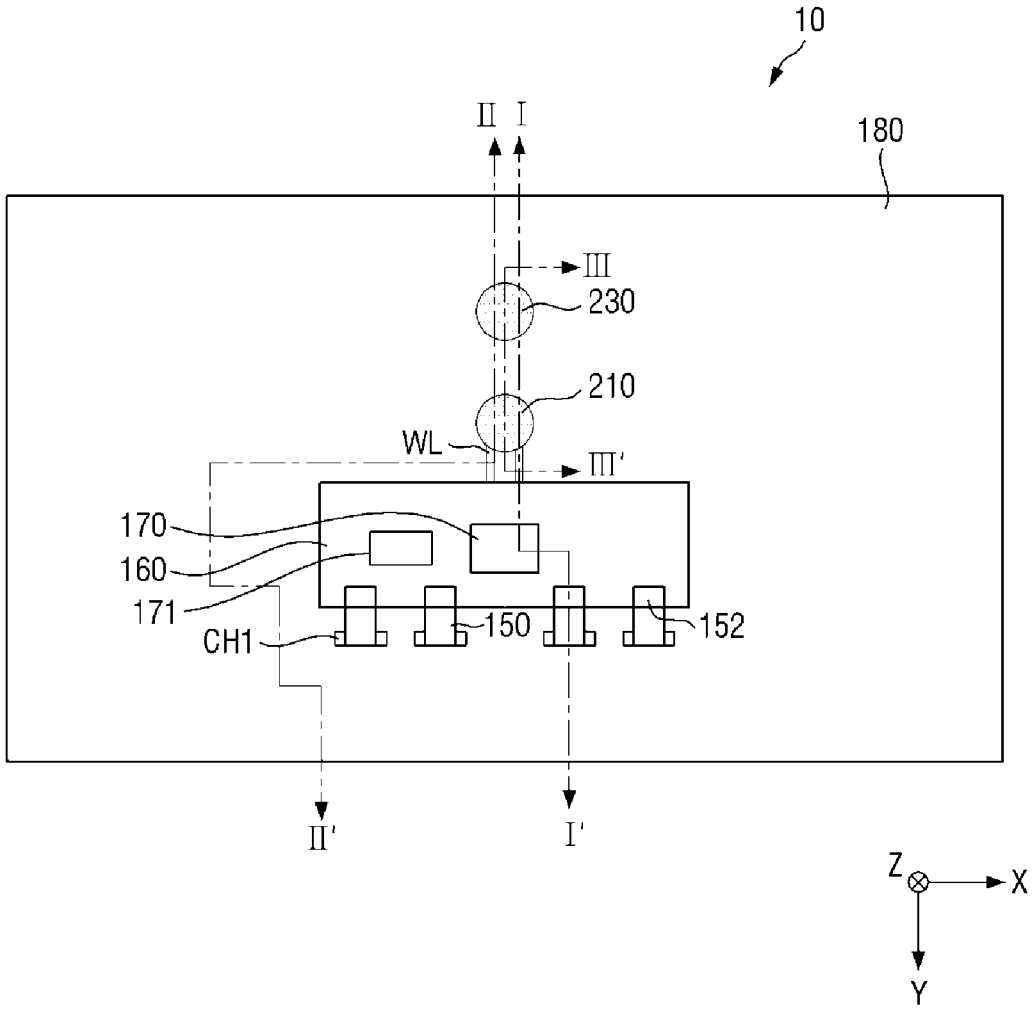
FIG. 3 is a bottom view of the display device according to an embodiment.
Figure 4:
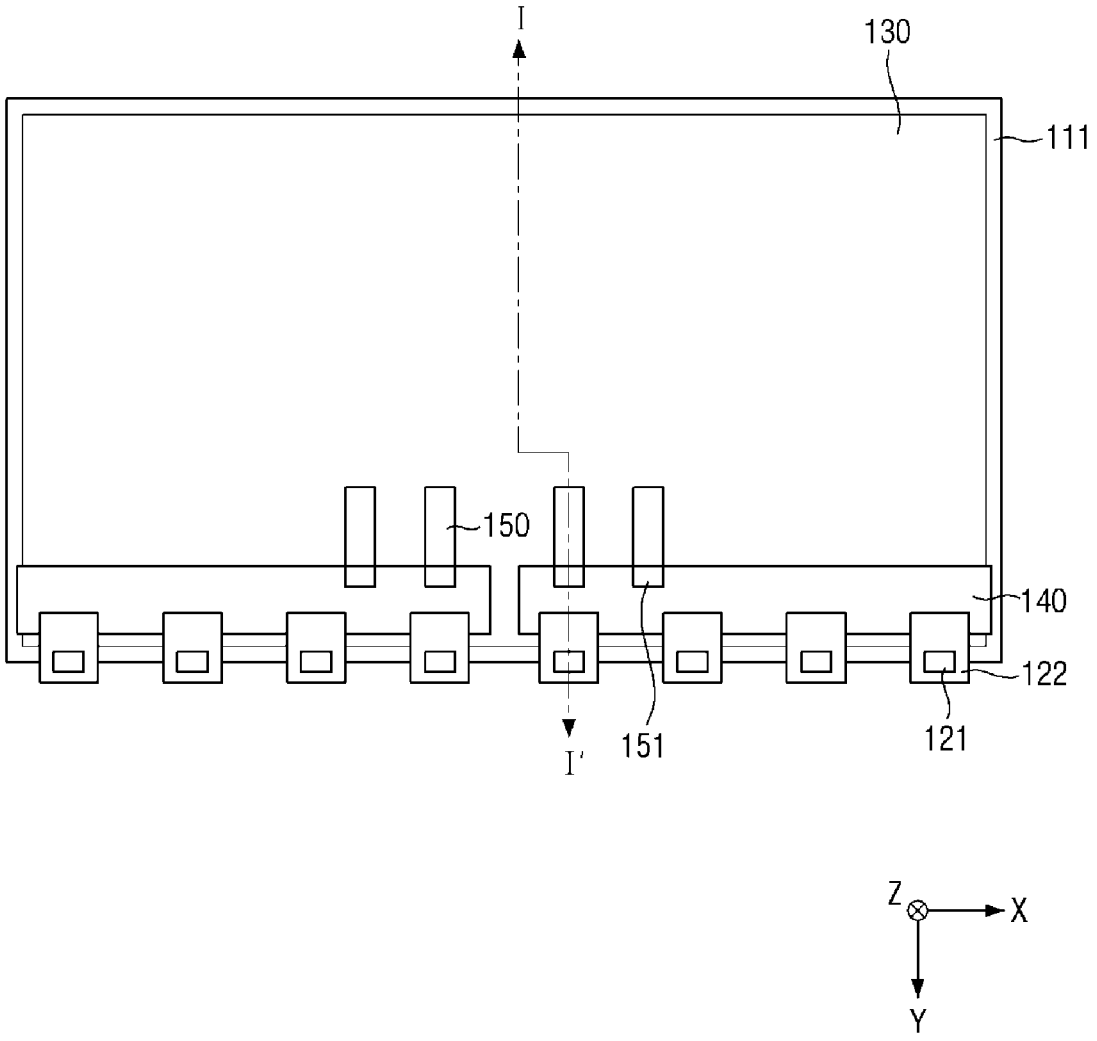
FIG. 4 is a bottom view of the display device excluding a lower cover and a control circuit board from FIG. 3.
Figure 5:
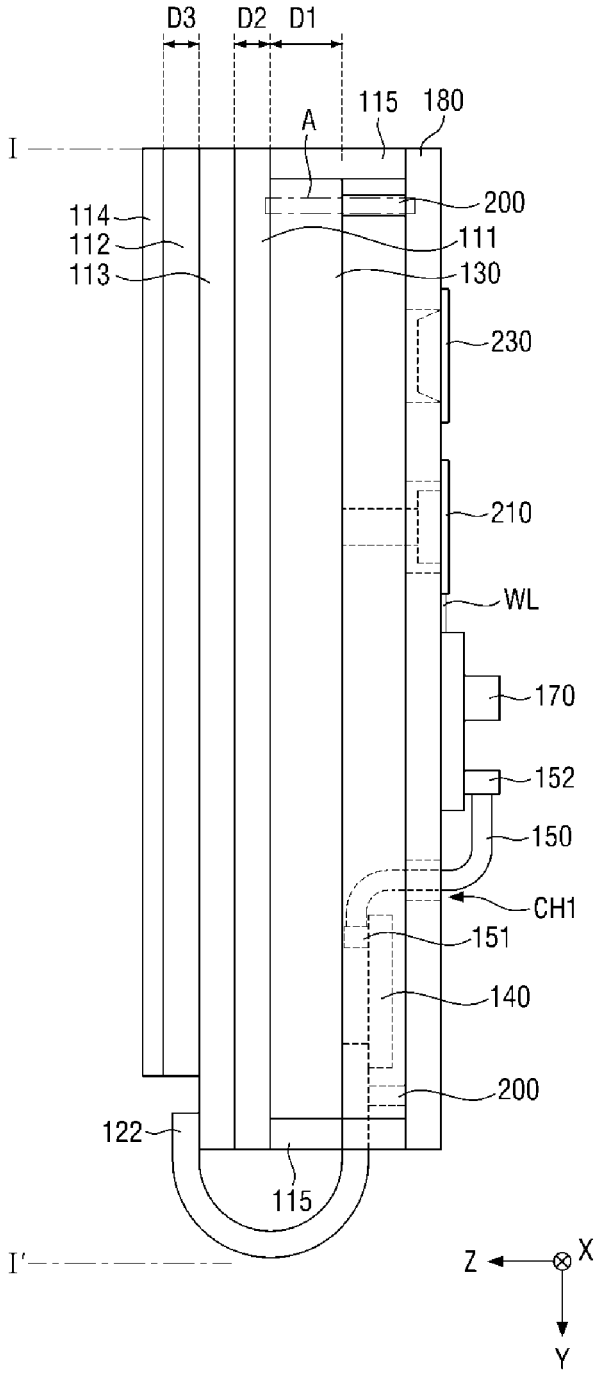
FIG. 5 is a cross-sectional view of the display device taken along line I-I' of FIGS. 3 and 4.

FIG. 1 is a perspective view of a display device 10 according to an embodiment. FIG. 2 is an exploded perspective view of the display device 10 according to an embodiment. FIG. 3 is a bottom view of the display device 10 according to an embodiment. FIG. 4 is a bottom view of the display device 10 excluding a lower cover 180 and a control circuit board 160 from FIG. 3. FIG. 5 is a cross-sectional view of the display device 10 taken along line I-I' of FIGS. 3 and 4.

Referring to FIGS. 1 through 5, an embodiment of the display device 10 includes a set cover 100, a display panel 110, source driving circuits 121, flexible films 122, a heat dissipation film 130, source circuit boards 140, cables 150, the control circuit board 160, a timing control circuit 170, and the lower cover 180.

Herein, the terms "above", "top" and "upper surface" indicate a direction in which a second substrate 112 is disposed with respect to a first substrate 111 of the display panel 110, that is, a Z-axis direction, and the terms "below," "bottom" and "lower surface" indicate a direction in which the lower cover 180 is disposed with. respect to the first substrate 111 of the display panel 110, that is, a direction opposite to the Z-axis direction. The Z-axis direction may be a thickness direction of the display panel 110. In addition, "left," "right," "upper" and "lower" indicate directions when the display panel 110 is viewed in a plan view or a plan view in the Z-axis direction. For example, "left" indicates an X-axis direction, "right" indicates a direction opposite to the X-axis direction, "upper" indicates a Z-axis direction, and "lower" indicates a direction opposite to the Z-axis direction.

The set cover 100 may surround edges of the display panel 110. The set cover 100 may cover a non-display area excluding a display area of the display panel 110. In an embodiment, the set cover 100 may include an upper set cover 101 and a lower set cover 102 as illustrated in FIG. 2. The upper set cover 101 may cover edge portions of an upper surface of the display panel 110, and the lower set cover 102 may cover lower and side surfaces of the display panel 110. The upper set cover 101 and the lower set cover 102 may be coupled to each other by a fixing member such as a screw or an adhesive member such as a double-sided tape or an adhesive. The upper set cover 101 and the lower set cover 102 may include or be made of a plastic or a metal or may include both plastic and metal.

The display panel 110 may be rectangular in a plan view. In one embodiment, for example, the display panel 110 may have a rectangular planar shape having long sides in a first direction (X-axis direction) and short sides in a second direction (Y-axis direction) as illustrated in FIG. 2. Each corner where a long side extending in the first direction (X-axis direction) meets a short side extending in the second direction (Y-axis direction) may be right-angled or may be rounded with a predetermined curvature. The planar shape of the display panel 110 is not limited to the rectangular shape, but may be variously modified to have another polygonal shape, a circular shape or an elliptical shape.

In an embodiment, as shown in FIG. 2, the display panel 110 is flat. However, embodiments are not limited thereto. The display panel 110 may also be bent with a predetermined curvature.

The display panel 110 may include the first substrate 111 and the second substrate 112. The first substrate 111 and the second substrate 112 may be rigid or flexible. The first substrate 111 may include or be made of a glass or a plastic, and the second substrate 112 may include or be made of a glass, a plastic, an encapsulation layer, or a barrier film. The plastic may be polyethersulfone ("PES"), polyacrylate ("PA"), polyarylate ("PAR"), polyetherimide ("PEI"), polyethylene naphtholate ("PEN"), polyethylene terepthalate ("PET"), polyphenylene sulfide ("PPS"), polyallylate, polyimide ("PI"), polycarbonate ("PC"), cellulose triacetate ("CAT"), cellulose acetate propionate ("CAP"), or a combination of these materials. The encapsulation layer or the barrier film may be a film in which a plurality of inorganic layers are stacked on one another.

Figure 7:
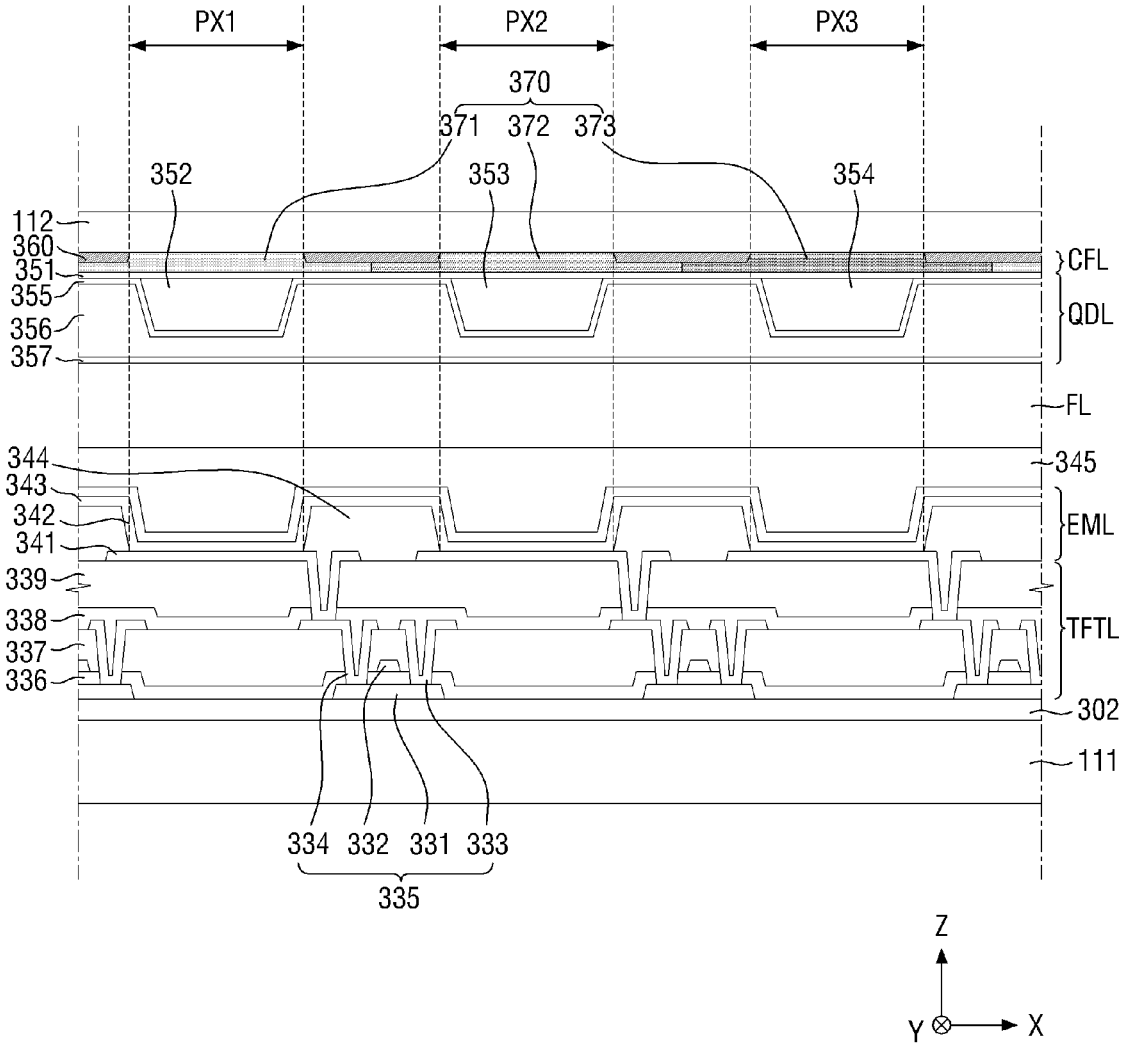
FIG. 7 is a cross-sectional view of an embodiment of a display area of a display panel.

In an embodiment, the display panel 110 may include a display layer 113 disposed between the first substrate 111 and the second substrate 112 as illustrated in FIG. 5. In an embodiment, the display layer 113 may include a thin-film transistor layer TFTL, a light emitting element layer EML, a filler FL, a light wavelength conversion layer QDL, and a color filter layer CFL as illustrated in FIG. 7. In such an embodiment, the first substrate 111 may be a thin-film transistor substrate in which the thin-film transistor layer TFTL, the light emitting element layer EML and a thin-film encapsulation layer TFTL are disposed, the second substrate 112 may be a color filter substrate in which the light wavelength conversion layer QDL and the color filter layer CFL are disposed, and the filler FL may be disposed between the thin-film encapsulation layer TFTL of the first substrate 111 and the light wavelength conversion layer QDL of the second substrate 112. The display layer 113 of the display panel 110 will be described in greater detail later with reference to FIG. 7.

In an embodiment, the display panel 110 may further include a polarizing film 114 disposed on the second substrate 112 as illustrated in FIG. 5. The polarizing film 114 may be attached onto the second substrate to prevent a decrease in visibility due to reflection of external light.

A side of each of the flexible films 122 may be attached onto a surface of the first substrate 111 of the display panel 110, and another side may be attached onto a surface of one of the source circuit boards 140. In an embodiment, the first substrate 111 is larger in size than the second substrate 112, and a side of the first substrate 111 may be exposed without being covered by the second substrate 112. The flexible films 122 may be attached to the exposed side of the first substrate 111 which is not covered by the second substrate 112. Each of the flexible films 122 may be attached onto the surface of the first substrate 111 and the surface of one of the source circuit boards 140 by using an anisotropic conductive film.

Each of the flexible films 122 may be a tape carrier package or a chip on film. In an embodiment, each of the flexible films 122 is bendable, such that the flexible films 122 may be bent toward a lower surface of the first substrate 111 as illustrated in FIGS. 4 and 5. In such an embodiment, the source circuit boards 140, the cables 150, and the control circuit board 160 may be disposed on the lower surface of the first substrate 111.

In an embodiment, eight flexible films 122 are attached onto the first substrate 111 of the display panel 110 as shown in FIG. 2, but the number of the flexible films 122 is not limited thereto.

The source driving circuits 121 may be disposed on surfaces of the flexible films 122, respectively. The source driving circuits 121 may be formed as integrated circuits. Each of the source driving circuits 121 converts digital video data into analog data voltages based on a source control signal of the timing control circuit 170 and supplies the analog data voltages to data lines of the display panel 110 through the flexible films 122.

Each of the source circuit boards 140 may be connected to the control circuit board 160 by the cables 150. In an embodiment, each of the source circuit boards 140 may include first connectors 151 for connection to the cables 150. The source circuit boards 140 may be flexible printed circuit boards or printed circuit boards. The cables 150 may be flexible cables.

The control circuit board 160 may be connected to the source circuit boards 140 via the cables 150. In an embodiment, the control circuit board 160 may include second connectors 152 for connection to the cables 150. The control circuit board 160 may be a flexible printed circuit board or a printed circuit board.

In an embodiment, four cables 150 connect the source circuit hoards 140 and the control circuit board 160 as shown in FIG. 2, but the number of the cables 150 is not limited thereto. In an embodiment, the cables 150 are connected to two source circuit boards 140 as illustrated in FIG. 2, but the number of the source circuit boards 140 is not limited thereto.

The timing control circuit 170 may be disposed on a surface of the control circuit board 160. The timing control circuit 170 may be formed as an integrated circuit. The timing control circuit 170 may receive digital video data and timing signals from a system on chip of a system circuit board and generate a source control signal for controlling the timings of the source driving circuits 121 based on the timing signals.

The system on chip may be mounted on the system circuit board connected to the control circuit board 160 via another flexible cable and may be formed as an integrated circuit. The system on chip may be a processor of a smart television, a central processing unit ("CPU") or graphics card of a personal computer ("PC") or a laptop computer, or an application processor of a smartphone or tablet PC. The system circuit board may be a flexible printed circuit board or a printed circuit board.

A power supply circuit (not shown) may be additionally attached onto the surface of the control circuit board 160. The power supply circuit may generate voltages used for driving the display panel 110 from main power received from the system circuit board and supply the generated voltages to the display panel 110. In one embodiment, for example, the power supply circuit may generate a high-potential voltage, a low-potential voltage and an initialization voltage for driving organic light emitting elements and supply the generated voltages to the display panel 110. In an embodiment, the power supply circuit may generate driving voltages for driving the source driving circuits 121, the timing control circuit 170, etc. and supply the generated voltages. The power supply circuit may be formed as an integrated circuit. Alternatively, the power supply circuit may be disposed on a power circuit board formed separately from the control circuit board 160. The power circuit board may be a flexible printed circuit board or a printed circuit board.

In an embodiment, as illustrated in FIGS. 4 and 5, the heat dissipation film 130 may be disposed on another surface of the first substrate 111 which does not face the second substrate 112, that is, on the lower surface of the first substrate 111. In an embodiment, a first sound generator 210 and a second sound generator 230 may be disposed on a surface of the heat dissipation film 130 which does not face the first substrate 111, that is, on a lower surface of the heat dissipation film 130. The heat dissipation film 130 dissipates heat generated by the first sound generator 210 and the second sound generator 230. In such an embodiment the heat dissipation film 130 may include a metal layer having high thermal conductivity, such as graphite, silver (Ag), copper (Cu) or aluminum (Al).

In an embodiment, the heat dissipation film 130 may include a plurality of graphite layers or a plurality of metal layers formed in the first direction (X-axis direction) and the second direction (Y-direction), not in a third direction (Z-direction). In such an embodiment, since the heat generated by the first sound generator 210 and the second sound generator 230 can be diffused in the first direction (X-axis direction) and the second direction (Y-axis direction), it can be released more effectively. Herein, the first direction (X-axis direction) may be a width direction (or a horizontal direction) of the display panel 110, the second direction (Y-axis direction) may be a height direction (or a vertical direction) of the display panel 110, and the third direction (Z-axis direction) may be a thickness direction of the display panel. Therefore, the heat dissipation film 130 can minimize the effect of the heat generated by the first sound generator 210 and the second sound generator 230 on the display panel 110.

In an embodiment, a thickness D1 of the heat dissipation film 130 may be greater than a thickness D2 of the first substrate 111 and a thickness D3 of the second substrate 112 such that the heat generated by the first sound generator 210 and the second sound generator 230 may be effectively prevented from affecting the display panel 110.

The size of the heat dissipation film 130 may be smaller than that of the first substrate 111. Therefore, edges of the surface of the first substrate 111 may be exposed without being covered by the heat dissipation film 130.

In an embodiment, the first sound generator 210 may be a vibration device capable of vibrating the display panel 110 in the third direction (Z-axis direction). In such an embodiment, the display panel 110 may serve as a diaphragm for outputting sound.

In an embodiment, the first sound generator 210 may be an exciter that vibrates the display panel 110 by generating a magnetic force using a voice coil therein. In an embodiment, the second sound generator 230 may be a passive radiator that generates sound by contracting or expanding in response to a change in internal pressure of the display device 10.

In an embodiment, the first sound generator 210 may serve as a mid- to high-frequency sound generator that outputs sound in a mid- to high-frequency range, and the second sound generator 230 may serve as a low-frequency sound generator that outputs sound in a low-frequency range lower than the frequency range of sound output by the first sound generator 210.

In an embodiment, the display device 10 includes two sound generators 210 and 230 as shown in FIG. 2, but the number of the sound generators 210 and 230 is not limited thereto. The first sound generator 210 and the second sound generator 230 will be described in greater detail later with reference to FIGS. 8 through 10.

The lower cover 180 may be disposed on the surface of the heat dissipation film 130. The lower cover 180 may be attached to the edge portions of the surface of the first substrate 111 of the display panel 110 by a first adhesive member 115. The first adhesive member 115 may be a double-sided tape including a buffer layer such as a foam. The lower cover 180 may include a metal or a tempered glass.

The display device 10 may output sound using the display panel 110 as a diaphragm through the first and second sound generators 210 and 230. Therefore, since sound may be output forward from the display device 10, sound quality may be improved. In such an embodiment, the first and second sound generators 210 and 230 make it possible to omit a speaker generally provided on a lower surface or a side of a conventional display panel.

In an embodiment, the display device 10 may be a medium- or large-sized display device including a plurality of source driving circuits 121 as shown in FIGS. 1 and 2, but embodiments are not limited thereto. Alternative, the display device 10 may be a small-sized display device including a single source driving circuit 121. In such an embodiment, the flexible films 122, the source circuit boards 140, and the cables 150 may be omitted. In such an embodiment, the source driving circuits 121 and the timing control circuit 170 may be integrated into one integrated circuit and then attached onto one flexible circuit board or attached onto the first substrate 111 of the display panel 110. In such an embodiment, the display device 10 may be the medium- or large-sized display device including monitors and televisions, for example, or the small-sized display device including smartphones and tablet PCs, for example.

In an embodiment, the flexible films 122 may be bent toward the lower surface of the heat dissipation film 130 as illustrated in FIGS. 4 and 5. Therefore, the source circuit boards 140 may be disposed on the surface of the heat dissipation film 130.

In an embodiment, the source circuit boards 140 are disposed on the surface of the heat dissipation film 130, and the control circuit board 160 is disposed on a first surface of the lower cover 180. In such an embodiment, the source circuit boards 140 are disposed between the surface of the heat dissipation film 130 and a second surface of the lower cover 180. Therefore, the cables 150 connected to the first connectors 151 of the source circuit boards 140 may be connected to the second connectors 152 of the control circuit board 160 via first cable holes CH1 defined through the lower cover 180.

A sound driving circuit 171 as well as the timing control circuit 170 may be disposed on the control circuit board 160.

The sound driving circuit 171 may receive a sound control signal, which is a digital signal, from the system circuit board. The sound driving circuit 171 may be formed as an integrated circuit and may be disposed on the control circuit board 160 or the system circuit board. The sound driving circuit 171 may include a digital signal processor ("DSP") for processing a sound control signal which is a digital signal, a digital-to-analog converter ("DAC") for converting the digital signal processed by the DSP into driving voltages which are analog signals, and an amplifier ("AMP") for amplifying the analog driving voltages output from the DAC and outputting the amplified analog driving voltages. The analog driving voltages may include a positive driving voltage and a negative driving voltage.

The sound driving circuit 171 may generate a first sound signal for driving the first sound generator 210 based on a sound control signal.

In an embodiment where the sound driving circuit 171, the first sound generator 210, and the second sound generator 230 are disposed on the lower cover 180 as illustrated in FIG. 3, the first sound generator 210 and the second sound generator 230 may be fixed to the lower cover 180.

The first sound generator 210 may be electrically connected to the control circuit board 160 by a sound signal line WL. The first sound generator 210 may receive the first sound signal through the sound signal line WL. The first sound generator 210 may output sound by vibrating the display panel 110 in response to the received first sound signal.

In an embodiment, the second sound generator 230 may passively output sound based on a change in internal pressure without receiving a sound signal. In such an embodiment, a line for transmitting a sound signal may be omitted. The second sound generator 230 may output sound by vibrating in response to the vibration of the first sound generator 210.

In an embodiment, the number of the sound generators implemented as exciters and the number of the sound generators implemented as passive radiators are not limited to those illustrated in FIGS. 3 through 5.

In some embodiments, a buffer member (not shown) including an elastic material may be further disposed between the display panel 110 and the lower cover 180. The buffer member may effectively prevent elements disposed between the display panel 110 and the lower cover 180 from being damaged when vibrations are generated by the first sound generator 210.

A blocking member 200 may be located between the heat dissipation film 130 and the lower cover 180. The blocking member 200 may block or prevent movement of sound waves (or wavelengths).

Figure 11:
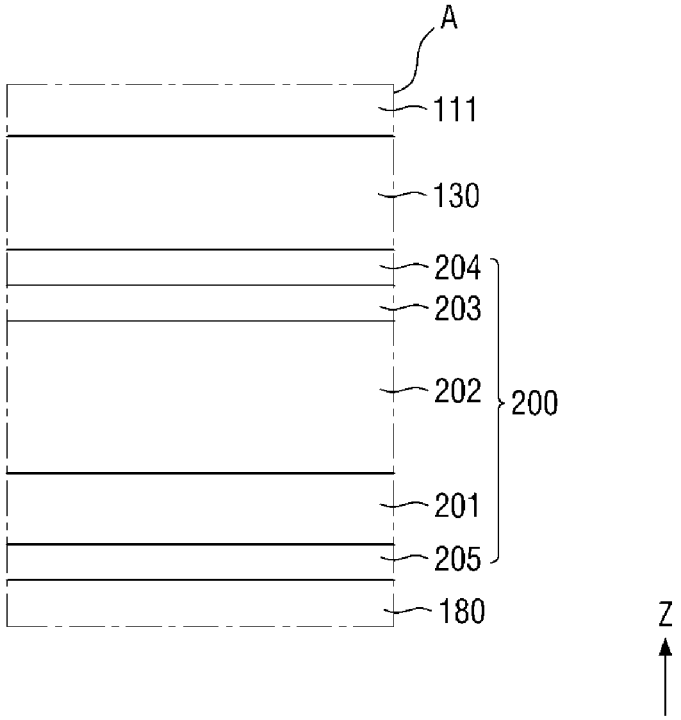
FIG. 11 is an enlarged view of area A of FIG. 5.

FIG. 11 is an enlarged view of area A of FIG. 5. Referring additionally to FIG. 11, the blocking member 200 may include a base film 201, a buffer layer 202, a sacrificial layer 203, a first adhesive layer 204, and a second adhesive layer 205.

The base film 201 may include or be made of plastic. In one embodiment, for example, the base film 201 may be PET.

The buffer layer 202 may be disposed on a surface of the base film 201. The buffer layer 202 may include or be made of a foam having elasticity. In one embodiment, for example, the buffer layer 202 may include or be made of polyurethane, silicone, rubber, or aerogel.

The sacrificial layer 203 may be disposed on a surface of the buffer layer 202. The sacrificial layer 203 may be separated in a case where the blocking member 200 is detached after being wrongly attached. In this case, the first adhesive layer 204 and a portion of the sacrificial layer 203 may remain on the surface of the heat dissipation film 130. The sacrificial layer 203 may include or be made of a material with low elasticity. In one embodiment, for example, the sacrificial layer 203 may include or be made of polyurethane. In some embodiments, the sacrificial layer 203 may be omitted.

The first adhesive layer 204 may be disposed on a surface of the sacrificial layer 203. The first adhesive layer 204 may be attached onto the surface of the heat dissipation film 130. The first adhesive layer 204 may be, but is not limited to, an acrylic adhesive or a silicone adhesive.

The second adhesive layer 205 may be disposed on another surface of the base film 201. The second adhesive layer 205 may be disposed on the second surface of the lower cover 180. The second adhesive layer 205 may be, but is not limited to, an acrylic adhesive or a silicone adhesive.

Figure 6:
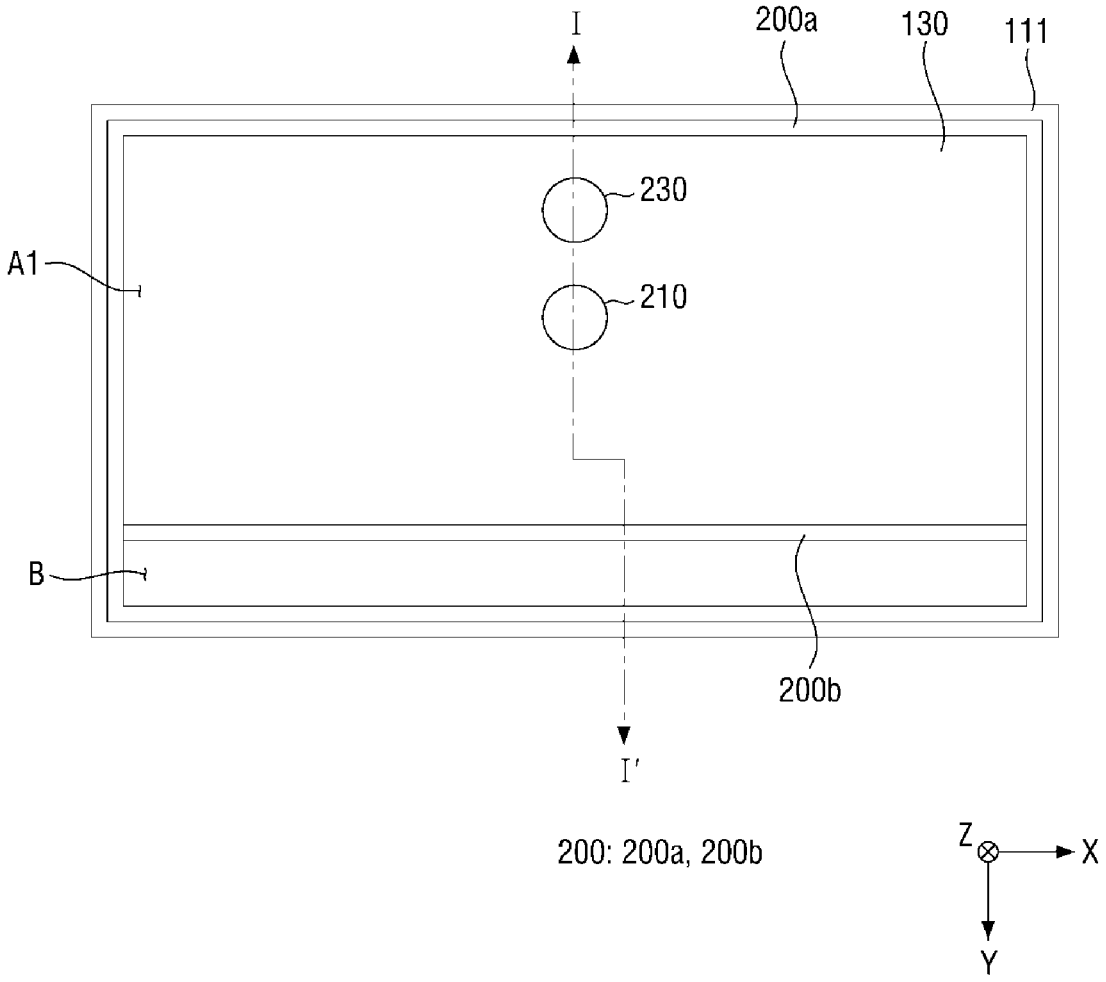
FIG. 6 is a bottom view illustrating a blocking member and sound generators of the display device of FIG. 3.

FIG. 6 is a bottom view illustrating the blocking member 200 and the sound generators 210 and 230 of the display device 10 of FIG. 3. For ease of description, only the first substrate 111 of the display panel 110, the heat dissipation film 130, the blocking member 200, the first sound generator 210 and the second sound generator 230 are illustrated in FIG. 6, and the source driving circuits 121, the flexible films 122, the source circuit boards 140, the cables 150, the control circuit board 160, the timing control circuit 170, and the lower cover 180 are omitted from FIG. 6.

Referring to FIGS. 5 and 6, the size of the heat dissipation film 130 may be smaller than that of the first substrate 111. Thus, the four edges of the surface of the first substrate 111 may be exposed without being covered by the heat dissipation film 130.

The blocking member 200 may include a first portion 200*a* and a second portion 200*b*.

The first portion 200*a* may be located between the heat dissipation film 130 and the lower cover 180 and may completely surround edges of the heat dissipation film 130 in a plan view. The first portion 200*a* may define an air gap space for transmitting sound waves between the heat dissipation film 130 and the lower cover 180. In an embodiment, the first portion 200*a* may connect the lower cover 180 to the heat dissipation film 130 in a sealed manner at edges of the air gap space, thereby sealing the air gap space. The first portion 200*a* may be attached to the surface of the heat dissipation film 130 and the second surface of the lower cover 180.

In an embodiment, where the first portion 200*a* defines the air gap space sealed on all sides, a space in which the first sound generator 210 and the second sound generator 230 may vibrate may be secured. In such an embodiment, the sound generated by the first sound generator 210 and the second sound generator 230 may be prevented from leaking out along sides of the display device 10.

The second portion 200*b* may divide the air gap space defined between the heat dissipation film 130 and the lower cover 180 by the first portion 200*a* into a sound area A1 and a circuit area B.

The sound area A1 is an area where the first sound generator 210 and the second sound generator 230 are disposed. All sides of the sound area A1 may be sealed by the first portion 200*a* and the second portion 200*b*. Accordingly, the sound generated by the first sound generator 210 and the second sound generator 230 may not leak out of the display device 10. In such an embodiment, the sound area A1 forms a completely sealed space, such that the pressure in the sound area A1 may be maintained substantially constant. Accordingly, a change in the pressure of the air gap space caused by the vibration of the first sound generator 210 may be more effectively transmitted to the second sound generator 230. In such an embodiment, since a pressure change is more effectively transmitted to the second sound generator 230, the characteristics of sound output from the second sound generator 230, which is a passive radiator, may be enhanced. In such an embodiment, the intensity or sound pressure of sound generated in the display panel 110 may be prevented from being reduced by the above vibration. Accordingly, sound output characteristics in the mid- to high-frequency range and the low-frequency range may be enhanced.

The circuit area B is an area where the source circuit boards 140 are disposed. All sides of the circuit area B may be sealed by the first portion 200*a* and the second portion 200*b*.

If vibrations generated by the first sound generator 210 and the like are continuously transmitted to the source circuit boards 140, etc., there is a possibility that the source circuit boards 140 will be damaged or their performance will deteriorate.

According to an embodiment, the air gap space is divided into the sound area A1 and the circuit area B by the second portion 200*b*, such that vibrations generated by the first sound generator 210 and the like may be prevented from being transmitted to the source circuit boards 140, the source driving circuits 121, the flexible films 122, etc., or such a transmission of the vibrations may be substantially reduced.

The size of the circuit area B may vary according to the size of circuit boards disposed in the circuit area B. In an alternative embodiment, where no circuit is disposed on the heat dissipation film 130, the circuit area B may be omitted.

The blocking member 200 may also be disposed in one of various forms, which will be described in greater detail later with reference to FIGS. 12 and 13.

FIG. 7 is a cross-sectional view of an embodiment of the display area of the display panel 110.

Referring to FIG. 7, the display panel 110 may include the first substrate 111, the second substrate 112, the thin-film transistor layer TFTL, the light emitting element layer EML, the filler FL, the wavelength conversion layer QDL, and the color filter layer CFL.

A buffer layer 302 may be disposed on a surface of the first substrate 111 which faces the second substrate 112. The buffer layer 302 may be disposed on the first substrate 111 to protect thin-film transistors 335 and light emitting elements from moisture introduced through the first substrate 111 which is vulnerable to moisture penetration. The buffer layer 302 may include or be composed of a plurality of inorganic layers stacked alternately on one another. In one embodiment, for example, the buffer layer 302 may have a multilayer structure in which one or more inorganic layers selected from a silicon oxide (SiOx) layer, a silicon nitride (SiNx) layer, and SiON are alternately stacked. Alternatively, the buffer layer 302 may be omitted.

The thin-film transistor layer TFTL is disposed on the buffer layer 302. The thin-film transistor layer TFTL includes the thin-film transistors 335, a gate insulating layer 336, an interlayer insulating film 337, a protective layer 338, and a planarization layer 339.

The thin-film transistors 335 are disposed on the buffer layer 302. Each of the thin-film transistors 335 includes an active layer 331, a gate electrode 332, a source electrode 333, and a drain electrode 334. In an embodiment, as shown in FIG. 7, each of the thin-film transistors 335 is formed as a top-gate type in which the gate electrode 332 is located above the active layer 331. However, embodiments are not limited thereto. Alternatively, each of the thin-film transistors 335 may be formed as a bottom-gate type in which the gate electrode 332 is located under the active layer 331 or a double-gate type in which the gate electrode 332 is located both above and under the active layer 331.

The active layers 331 are disposed on the buffer layer 302. The active layers 331 may include or be made of a silicon-based semiconductor material or an oxide-based semiconductor material. A light shielding layer may be disposed between the buffer layer 302 and the active layers 331 to block external light from entering the active layers 331.

The gate insulating layer 336 may be disposed on the active layers 331. The gate insulating layer 336 may be an inorganic layer, for example, a SiOx layer, a SiNx layer, or may have a multilayer structure including or composed of these layers.

The gate electrodes 332 and gate lines may be disposed on the gate insulating layer 336. Each of the gate electrodes 332 and the gate lines may have a single layer structure or a multilayer structure, where each layer includes or is made of any one or more of molybdenum (Mo), aluminum (Al), chromium (Cr), gold (Au), titanium (Ti), nickel (Ni), neodymium (Ne), copper (Cu) and a combination (e.g., an alloy) thereof.

The interlayer insulating film 337 may be disposed on the gate electrodes 332 and the gate lines. The interlayer insulating film 337 may be an inorganic layer, for example, a SiOx layer, a SiNx layer, or may have a multilayer structure including or composed of these layers.

The source electrodes 333, the drain electrodes 334, and data lines may be disposed on the interlayer insulating film 337. Each of the source electrodes 333 and the drain electrodes 334 may be connected to an active layer 331 through a contact hole penetrating the gate insulating layer 336 and the interlayer insulating film 337. Each of the source electrodes 333, the drain electrodes 334 and the data lines may have a single layer structure or a multilayer structure, in which each layer includes or is made of any one or more of molybdenum (Mo), aluminum (Al), chromium (Cr), gold (Au), titanium (Ti), nickel (Ni), neodymium (Ne), copper (Cu), and a combination thereof.

The protective layer 338 for insulating the thin-film transistors 335 may be disposed on the source electrodes 333, the drain electrodes 334, and the data lines. The protective layer 338 may be an inorganic layer, for example, a SiOx layer, a SiNx layer, or may have a multilayer structure including or composed of these layers.

The planarization layer 339 may be disposed on the protective layer 338 to planarize steps due to the thin-film transistors 335. The planarization layer 339 may include or be made of an organic material such as acryl resin, epoxy resin, phenolic resin, polyamide resin, or polyimide resin.

The light emitting element layer EML is disposed on the thin-film transistor layer TFTL. The light emitting element layer EML includes light emitting elements and a pixel defining layer 344.

The light emitting elements and the pixel defining layer 344 are disposed on the planarization layer 339. In an embodiment, the light emitting elements may be organic light emitting devices. In such an embodiment, each of the light emitting elements may include an anode 341, a light emitting layer 342, and a cathode 343.

The anodes 341 may be disposed on the planarization layer 339. The anodes 341 may be connected to the drain electrodes 334 of the thin-film transistors 335 through contact holes defined through the protective layer 338 and the planarization layer 339.

The pixel defining layer 344 may be disposed on the planarization layer 339 and may cover edges of the anodes 341 to define pixels. In such an embodiment, the pixel defining layer 344 serves as a pixel defining layer for defining subpixels PX1 through PX3. Each of the subpixels PX1 through PX3 is an area in which the anode 341, the light emitting layer 342 and the cathode 343 are sequentially stacked so that holes from the anode 341 and electrons from the cathode 343 combine together in the light emitting layer 342 to emit light.

The light emitting layer 342 is disposed on the anodes 341 and the pixel defining layer 344. In an embodiment, the light emitting layer 342 may be an organic light emitting layer. The light emitting layer 342 may emit light having a short wavelength, such as blue light or ultraviolet light. The blue light may have a peak wavelength range of about 450 nanometers (nm) to about 490 nm, and the ultraviolet light may have a peak wavelength range of less than 450 nm. In such an embodiment, the light emitting layer 342 may be a common layer commonly provided for all of the subpixels PX1 through PX3. In such an embodiment, the display panel 110 may include the wavelength conversion layer QDL for converting short-wavelength light such as blue light or ultraviolet light emitted from the light emitting layer 342 into red light, green light and blue light and the color filter layer CFL for selectively transmitting the red light, green light and the blue light. In an embodiment, the light emitting layer 342 may be formed in a tandem structure of two or more stacks, for example, a tandem structure of three stacks in which three blue light emitting layers overlap each other. In such an embodiment, a charge generating layer may be further disposed between the stacks.

However, embodiments are not limited thereto. In an alternative embodiment, the light emitting layer 342 may include a quantum-dot material. Core of quantum dots may be selected from group II-VI compounds, group III-V compounds, group IV-VI compounds, group IV elements, group IV compounds, and a combination thereof.

The group II-VI compounds may be selected from binary compounds selected from CdSe, CdTe, ZnS, ZnSe, ZnTe, ZnO, HgS, HgSe, HgTe, MgSe, MgS and mixtures of the same; ternary compounds selected from AgInS, CuInS, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, MgZnSe, MgZnS and a combination thereof; and quaternary compounds selected from HgZnTeS, CdZnSeS, CdZnSeTe, CdZnSTe, CdHgSeS, CdHgSeTe, CdHgSTe, HgZnSeS, HgZnSeTe, HgZnSTe and a combination thereof.

The group III-V compounds may be selected from binary compounds selected from GaN, GaP, GaAs, GaSb, AlN, AlP, AlAs, AlSb, InN, InP, InAs, InSb and a combination thereof; ternary compounds selected from GaNP, GaNAs, GaNSb, GaPAs, GaPSb, AlNP, AlNAs, AlNSb, AlPAs, AlPSb, InGaP, InNP, InNAs, InNSb, InPAs, InPSb, GaAlNP and a combination thereof; and quaternary compounds selected from GaAlNAs, GaAlNSb, GaAlPAs, GaAlPSb, GaInNP, GaInNAs, GaInNSb, GaInPAs, GaInPSb, InAlNP, InAlNAs, InAlNSb, InAlPAs, InAlPSb and a combination thereof.

The group IV-VI compounds may be selected from binary compounds selected from SnS, SnSe, SnTe, PbS, PbSe, PbTe and a combination thereof; ternary compounds selected from SnSeS, SnSeTe, SnSTe, PbSeS, PbSeTe, PbSTe, SnPbS, SnPbSe, SnPbTe and a combination thereof; and quaternary compounds selected from SnPbSSe, SnPbSeTe, SnPbSTe and a combination thereof. The group IV elements may be selected from Si, Ge, and a combination thereof. The group IV compounds may be binary compounds selected from SiC, SiGe, and a combination thereof.

Here, the binary, ternary or quaternary compounds may be present in the particles at a uniform concentration or may be present in the same particles at partially different concentrations. In addition, the binary, ternary or quaternary compounds may have a core/shell structure in which one quantum dot surrounds another quantum dot. An interface between the core and the shell may have a concentration gradient in which the concentration of an element present in the shell is reduced toward the center.

In some embodiments, the quantum dots may have a core-shell structure including a core containing the above-described nanocrystal and a shell surrounding the core. The shell of each quantum dot may serve as a protective layer for maintaining semiconductor characteristics by preventing chemical denaturation of the core and/or as a charging layer for giving electrophoretic characteristics to the quantum dot. The shell may be a single layer or a multilayer. An interface between the core and the shell may have a concentration gradient in which the concentration of an element present in the shell is reduced toward the center. The shell of each quantum dot may be, for example, a metal or non-metal oxide, a semiconductor compound, or a combination thereof.

In one embodiment, for example, the metal or non-metal oxide may be, but is not limited to, a binary compound such as $SiO_2$, $Al_2O_3$, $TiO_2$, ZnO, MnO, $Mn_2O_3$, $Mn_3O_4$, CuO, FeO, $Fe_2O_3$, $Fe_3O_4$, CoO, $Co_3O_4$ or NiO or a ternary compound such as $MgAl_2O_4$, $CoFe_2O_4$, $NiFe_2O_4$ or $CoMn_2O_4$.

In an embodiment, the semiconductor compound may be, but is not limited to, CdS, CdSe, CdTe, ZnS, ZnSe, ZnTe, ZnSeS, ZnTeS, GaAs, GaP, GaSb, HgS, HgSe, HgTe, InAs, InP, InGaP, InSb, AlAs, AlP, or AlSb.

In an embodiment, the quantum dots may have a full width of half maximum ("FWHM") of an emission wavelength spectrum of about 45 nm or less, preferably about 40 nm or less, or more preferably about 30 nm or less. In such an embodiment, color purity and color reproducibility may be improved, and light emitted through the quantum dots may be radiated in all directions, thereby improving a wide viewing angle.

In an embodiment, the quantum dots may be in a form generally used in the art to which the disclosure pertains and is not limited to a particular form. More specifically, the quantum dots may be in the form of spherical, pyramidal, multi-arm or cubic nanoparticles, nanotubes, nanowires, nanofibers, or plate-like nanoparticles.

Each of the quantum dots may control the color of emitted light according to the particle size. Therefore, the quantum dots may have various emission colors such as blue, red, and green.

In an embodiment, where the light emitting layer 342 includes the quantum-dot material, the wavelength conversion layer QDL may be omitted.

In addition to the light emitting layer 342, a hole transporting layer and an electron transporting layer may be further located between the cathode 343 and each of the anodes 341.

Hereinafter, for convenience of description, embodiments where the light emitting layer 342 is an organic light emitting layer will now be described in detail.

The cathode 343 is disposed on the light emitting layer 342. The cathode 343 may be formed to cover the light emitting layer 342. The cathode 343 may be a common layer commonly provided for all pixels.

In an embodiment, the light emitting element layer EML may be formed as a top emission type which emits light toward the second substrate 112, that is, in an upward direction. In such an embodiment, the anodes 341 may include or be made of a metal material having high reflectivity, such as a stacked structure (Ti/Al/Ti) of Al and Ti, a stacked structure (ITO/Al/ITO) of Al and indium tin oxide ("ITO"), an APC alloy, or a stacked structure (ITO/APC/ITO) of an APC alloy and ITO. The APC alloy is an alloy of Ag, palladium (Pd), and Cu. In an embodiment, the cathode 343 may include or be made of a transparent conductive material ("TCO") capable of transmitting fight, such as ITO or indium zinc oxide ("IZO"), or a semi-transmissive conductive material such as magnesium (Mg), Ag or an alloy of Mg and Ag. In an embodiment, where the cathode 343 is made of a semi-transmissive conductive material, the light output efficiency may be increased by a microcavity. However, embodiments are not limited to thereto. In an alternative embodiment, the light emitting element layer EML may be formed as a bottom emission type. In such an embodiment, the cathode 343 may include a metal material having high reflectivity, and the anodes 341 may include or be made of a transparent conductive material or a semi-transmissive conductive material capable of transmitting light. For ease of description, embodiments where the light emitting element layer EML has a top emission structure will be described below in detail.

An encapsulation layer 345 is disposed on the lighting element layer EML. The encapsulation layer 345 serves to prevent oxygen or moisture from permeating into the light emitting layer 342 and the cathode 343. In such an embodiment, the encapsulation layer 345 may include at least one inorganic layer. The inorganic layer may include or be made of silicon nitride, aluminum nitride, zirconium nitride, titanium nitride, hafnium nitride, tantalum nitride, silicon oxide, aluminum oxide, or titanium oxide. In an embodiment, the encapsulation layer 345 may further include at least one organic layer. The organic layer may have a sufficient thickness to prevent particles from penetrating the encapsulation layer 345 and entering the light emitting layer 342 and the cathode 343. The organic layer may include any one of epoxy, acrylate, and urethane acrylate. In an embodiment, the encapsulation layer 345 may include two inorganic layers and an organic layer located between the two inorganic layers.

The color filter layer CFL is disposed on a surface of the second substrate 112 which faces the first substrate 111. The color filter layer CFL may include a black matrix 360 and color filters 370.

The black matrix 360 may be disposed on the surface of the second substrate 112. The black matrix 360 may not overlap the subpixels PX1 through PX3 and may overlap the pixel defining layer 344. The black matrix 360 may include a black dye capable of blocking light or an opaque metal material.

The color filters 370 may overlap the subpixels PX1 through PX3. A first color filter 371 may overlap a first subpixel PX1, a second color filter 372 may overlap a second subpixel PX2, and a third color filter 373 may overlap a third subpixel PX3. In such an embodiment, the first color filter 371 may be a first color light transmitting filter that transmits light of a first color, the second color filter 372 may be a second color light transmitting filter that transmits light of a second color, and the third color filter 373 may be a third color light transmitting filter that transmits light of a third color. In one embodiment, for example, the first color may be red, the second color may be green, and the third color may be blue. In this case, the peak wavelength range of red light transmitted through the first color filter 371 may be about 620 nm to about 750 nm, the peak wavelength range of green light transmitted through the second color filter 372 may be about 500 nm to about 570 nm, and the peak wavelength range of blue light transmitted through the third color filter 373 may be about 450 nm to about 490 nm.

In an embodiment, edges of two adjacent color filters may overlap the black matrix 360. Therefore, the black matrix 360 may prevent color mixing that may occur when light emitted from the light emitting layer 342 of any one subpixel travels to a color filter of an adjacent subpixel.

An overcoat layer may be disposed on the color filters 370 to planarize steps due to the color filters 370 and the black matrix 360. Alternatively, the overcoat layer may be omitted.

The wavelength conversion layer QDL is disposed on the color filter layer CFL. The wavelength conversion layer QDL may include a first capping layer 351, a first wavelength conversion layer 352, a second wavelength conversion layer 353, a third wavelength conversion layer 354, a second capping layer 355, an interlayer organic layer 356, and a third capping layer 357.

The first capping layer 351 may be disposed on the color filter layer CFL. The first capping layer 351 may prevent moisture or oxygen from permeating into the first wavelength conversion layer 352, the second wavelength conversion layer 353 and the third wavelength conversion layer 354 from the outside through the color filter layer CFL. The first capping layer 351 may include or be made of an inorganic material such as silicon nitride, aluminum nitride, zirconium nitride, titanium nitride, hafnium nitride, tantalum nitride, silicon oxide, aluminum oxide, or titanium oxide.

The first wavelength conversion layer 352, the second wavelength conversion layer 353 and the third wavelength conversion layer 354 may be disposed on the first capping layer 351.

The first wavelength conversion layer 352 may overlap the first subpixel PX1. The first wavelength conversion layer 352 may convert short-wavelength light such as blue light or ultraviolet light emitted from the light emitting layer 342 of the first subpixel PX into light of the first color. In such an embodiment, the first wavelength conversion layer 352 may include a first base resin, a first wavelength shifter, and a first scatterer.

The first base resin may be a material having high light transmittance and superior dispersion characteristics for the first wavelength shifter and the first scatterer. In one embodiment, for example, the first base resin may include an organic material such as epoxy resin, acrylic resin, cardo resin, or imide resin.

The first wavelength shifter may convert or shift the wavelength range of incident light. The first wavelength shifter may be quantum dots, quantum rods, or phosphors. In on embodiment, for example, the first wavelength shifter is quantum dots, the first wavelength shifter may have a specific band gap according to its composition and size as a semiconductor nanocrystalline material. Thus, the first wavelength shifter may absorb incident light and then emit light having a unique wavelength. In an embodiment, the first wavelength shifter may have a core-shell structure including a core containing a nanocrystal and a shell surrounding the core. In such an embodiment, the nanocrystal that forms the core include group IV nanocrystals, group II-VI compound nanocrystals, group III-V compound nanocrystals, group IV-VI nanocrystals, and a combination thereof, for example. The shell may serve as a protective layer for maintaining semiconductor characteristics by preventing chemical denaturation of the core and/or as a charging layer for giving electrophoretic characteristics to the quantum dot. In an embodiment, the shell may have a single layer structure or a multilayer structure. The shell may be, for example, a metal or non-metal oxide, a semiconductor compound, or a combination thereof.

The first scatterer may have a refractive index different from that of the first base resin and may form an optical interface with the first base resin. In one embodiment, for example, the first scatterer pray be light scattering particles. In one embodiment, for example, the first scatterer may be metal oxide particles such as titanium oxide ($TiO_2$), silicon oxide ($SiO_2$), zirconium oxide ($ZrO_2$), aluminum oxide ($Al_2O_3$), indium oxide ($In_2O_3$), zinc oxide (ZnO), or tin oxide ($SnO_2$). Alternatively, the first scatterer may be organic particles such as acrylic resin or urethane resin.

The first scatterer may scatter incident light in random directions without substantially changing the wavelength of the light transmitted through the first wavelength conversion layer 352. Accordingly, the length of the path of the light transmitted through the first wavelength conversion layer 352 may be increased, thereby increasing the color conversion efficiency of the first wavelength shifter.

In an embodiment, the first wavelength conversion layer 352 may overlap the first color filter 371. Therefore, a portion of short-wavelength light such as blue light or ultraviolet light provided from the first subpixel PX1 may pass through the first wavelength conversion layer 352 as it is without being converted into light of the first color by the first wavelength shifter. However, the short-wavelength light such as blue light or ultraviolet light incident on the first color filter 371 without being converted by the first wavelength conversion layer 352 may not pass through the first color filter 371. In such an embodiment, light of the first color output from the first wavelength conversion layer 352 may pass through the first color filter 371 and proceed toward the second substrate 112.

The second wavelength conversion layer 353 may overlap the second subpixel PX2. The second wavelength conversion layer 353 may convert short-wavelength light such as blue light or ultraviolet light emitted from the light emitting layer 342 of the second subpixel PX2 into light of the second color. In such an embodiment, the second wavelength conversion layer 353 may include a second base resin, a second wavelength shifter, and a second scatterer. The second base resin, the second wavelength shifter and the second scatterer of the second wavelength conversion layer 353 are substantially the same as those of the first wavelength conversion layer 352, and thus any repetitive detailed description thereof will be omitted. In an embodiment, where the first wavelength shifter and the second wavelength shifter are quantum dots, the diameter of the second wavelength shifter may be smaller than that of the first wavelength shifter.

In an embodiment, the second wavelength conversion layer 353 may overlap the second color filter 372. Therefore, a portion of short-wavelength light such as blue light or ultraviolet light provided from the second subpixel PX2 may pass through the second wavelength conversion layer 353 as it is without being converted into light of the second color by the second wavelength shifter. However, the short-wavelength light such as blue light or ultraviolet light incident on the second color filter 372 without being converted by the second wavelength conversion layer 353 may not pass through the second color filter 372. In such an embodiment, light of the second color output from the second wavelength conversion layer 353 may pass through the second color filter 372 and proceed toward the second substrate 112.

The third wavelength conversion layer 354 may overlap the third subpixel PX3. The third wavelength conversion layer 354 may convert short-wavelength light such as blue light or ultraviolet light emitted from the light emitting layer 342 of the third subpixel PX3 into light of the third color. In such an embodiment, the third wavelength conversion layer 354 may include a third base resin and a third scatterer. The third base resin and the third scatterer of the third wavelength conversion layer 354 are substantially the same as those of the first wavelength conversion layer 352, and thus any repetitive detailed description thereof will be omitted.

In an embodiment, the third wavelength conversion layer 354 may overlap the third color filter 373. In an embodiment, where light provided from the third subpixel PX3 is blue light, the blue light provided from the third subpixel PX3 may pass through the third wavelength conversion layer 354 as it is without being converted by the third wavelength conversion layer 354. The light that passes through the third wavelength conversion layer 354 may pass through the third color filter 373 and proceed toward the second substrate 112. That is, when light provided from the third subpixel PX3 is blue light, the third wavelength conversion layer 354 may not include a wavelength shifter.

The second capping layer 355 may be disposed on the first wavelength conversion layer 352, the second wavelength conversion layer 353, the third wavelength conversion layer 354, and the first capping layer 351 not covered by the wavelength conversion layers 352 through 354. The second capping layer 355 prevents moisture or oxygen from permeating into the first wavelength conversion layer 352, the second wavelength conversion layer 353 and the third wavelength conversion layer 354 from the outside. The second capping layer 355 may include or be made of an inorganic material such as silicon nitride, aluminum nitride, zirconium nitride, titanium nitride, hafnium nitride tantalum nitride, silicon oxide, aluminum oxide, or titanium oxide.

The interlayer organic layer 356 may be disposed on the second capping layer 355. The interlayer organic layer 356 may be a planarization layer for planarizing steps due to the wavelength conversion layers 352 through 354. The interlayer organic layer 356 may include or be made of an organic material such as acryl resin, epoxy resin, phenolic resin, polyamide resin, or polyimide resin.

The third capping layer 357 may be disposed on the interlayer organic layer 356. The third capping layer 357 may include or be made of an inorganic material such as silicon nitride, aluminum nitride, zirconium nitride, titanium nitride, hafnium nitride, tantalum nitride, silicon oxide, aluminum oxide, or titanium oxide.

The filler FL may be disposed between the encapsulation layer 345 disposed on the first substrate 111 and the third capping layer 357 disposed on the second substrate 112. The filler FL may include or be made of a material having a buffer function. In one embodiment, for example, the filler FL may include or be made of an organic material such as acryl resin, epoxy resin, phenolic resin, polyamide resin, or polyimide resin.

In an embodiment, a sealing material for bonding the first substrate 111 and the second substrate 112 may be disposed in the non-display area of the display panel 110. When seen in a plan view, the filler FL may be surrounded by the sealing material. The sealing material may be a glass frit or a sealant.

In an embodiment, as illustrated in FIG. 7, the first through third subpixels PX1 through PX3 may emit short-wavelength light such as blue light or ultraviolet light. Light of the first subpixel PX1 is converted into light of the first color by the first wavelength conversion layer 352 and then output through the first color filter 371. Light of the second subpixel PX2 is converted into light of the second color by the second wavelength conversion layer 353 and then output through the second color filter 372. Light of the third subpixel PX3 is output through the third wavelength conversion layer 354 and the third color filter 373. Therefore, white light may be output.

In an embodiment, as illustrated in FIG. 7, each of the subpixels PX1 through PX3 is formed as a top emission type which emits light toward the second substrate 112, that is, in the upward direction. Therefore, the heat dissipation film 130 including an opaque material such as graphite or aluminum may be disposed on the other surface of the first substrate 111.

Figure 8:
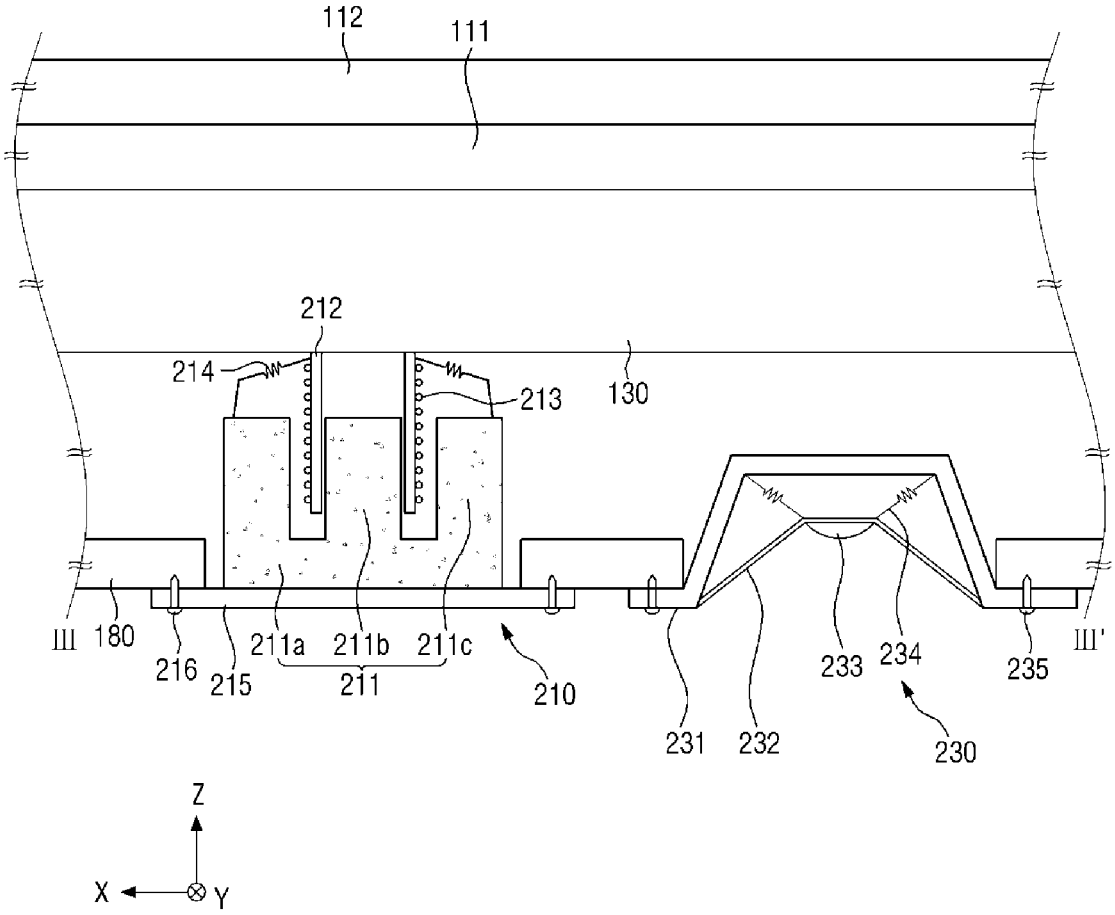
FIGS. 8 through 10 are cross-sectional views taken along line III-III' of FIG. 3, illustrating vibration methods of the sound generators and vibration of the display panel.

FIG. 8 is a cross-sectional view illustrating an embodiment of the first sound generator 210 and the second sound generator 230 of FIG. 3. FIG. 8 is a cross-section taken along III-III' of FIG. 3.

Referring to FIG. 8, in an embodiment, the first sound generator 210 may be an exciter that vibrates the display panel 110 by generating a magnetic force using a voice coil therein. In such an embodiment, a hole may be defined or formed in an area of the lower cover 180 where the first sound generator 210 is disposed.

The first sound generator 210 may include a magnet 211, a bobbin 212, a voice coil 213, a first damper 214, and a lower plate 215.

The magnet 211 is a permanent magnet, and a sintered magnet such as barium ferrite can be used. The material of the magnet 211 may be, but is not limited to, ferric trioxide ($Fe_2O_3$), barium carbonate ($BaCO_3$), a neodymium magnet, strontium ferrite with an improved magnetic component, or aluminum (Al), nickel (Ni) or cobalt (Co) alloy cast magnet. The neodymium magnet may be, for example, neodymium-iron-boron (Nd—Fe—B).

The magnet 211 may include a plate 211*a*, a central protrusion 211*b* protruding from a center of the plate 211*a*, and sidewalls 211*c* protruding from edges of the plate 211*a*. The central protrusion 211*b* and the sidewalls 211*c* may be spaced apart from each other by a predetermined distance. Therefore, a predetermined space may be formed between the central protrusion 211*b* and each of the sidewalls 211*c*. In an embodiment, the magnet 211 may be in a shape of a circular cylinder, specifically, a circular cylinder having a circular space formed in any one base of the circular cylinder.

The central protrusion 211*b* of the magnet 211 may have the magnetism of a north (N) pole, and the plate 211*a* and the sidewalls 211*c* may have the magnetism of a south (S) pole. Therefore, an external magnetic field may be formed between the central protrusion 211*b* and the plate 211*a* of the magnet 211 and between the central protrusion 211*b* and the sidewalls 211*c*.

The bobbin 212 may be cylindrical. The central protrusion 211*b* of the magnet 211 may be disposed inside the bobbin 212. In an embodiment, the bobbin 212 may surround the central protrusion 211*b* of the magnet 211. In such an embodiment, the sidewalls 211*c* of the magnet 211 may be disposed outside the bobbin 212. That is, the sidewalls 211*c* of the magnet 211 may surround the bobbin 212. A space may be formed between the bobbin 212 and the central protrusion 211*b* of the magnet 211 and between the bobbin 212 and the sidewalls 211*c* of the magnet 211.

The bobbin 212 may include or be made of a material obtained by processing pulp or paper, aluminum or magnesium or a combination thereof, a synthetic resin such as polypropylene, or a polyamide-based fiber. An end of the bobbin 212 may be attached to the heat dissipation film 130 using an adhesive member. The adhesive member may be a double-sided tape.

Figure 9:
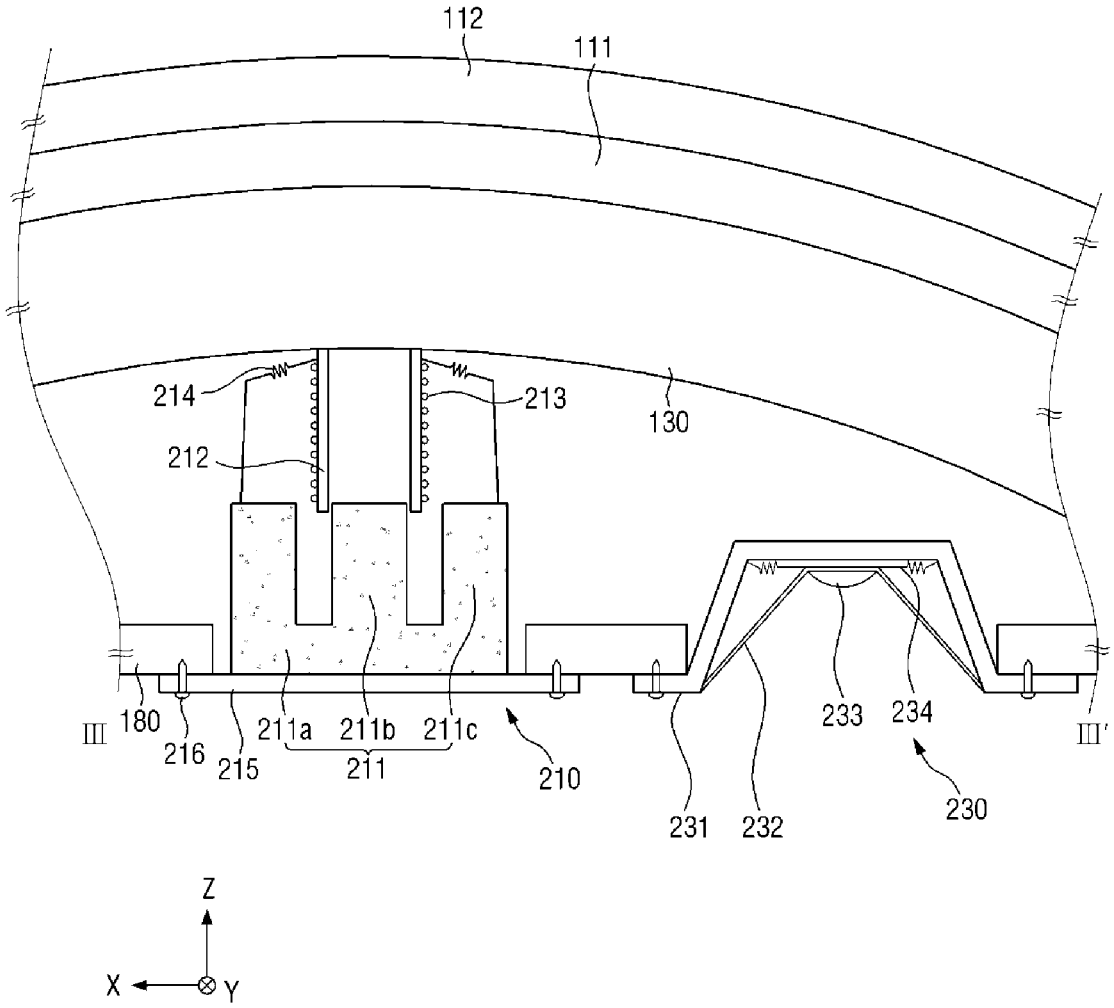
Figure 10:
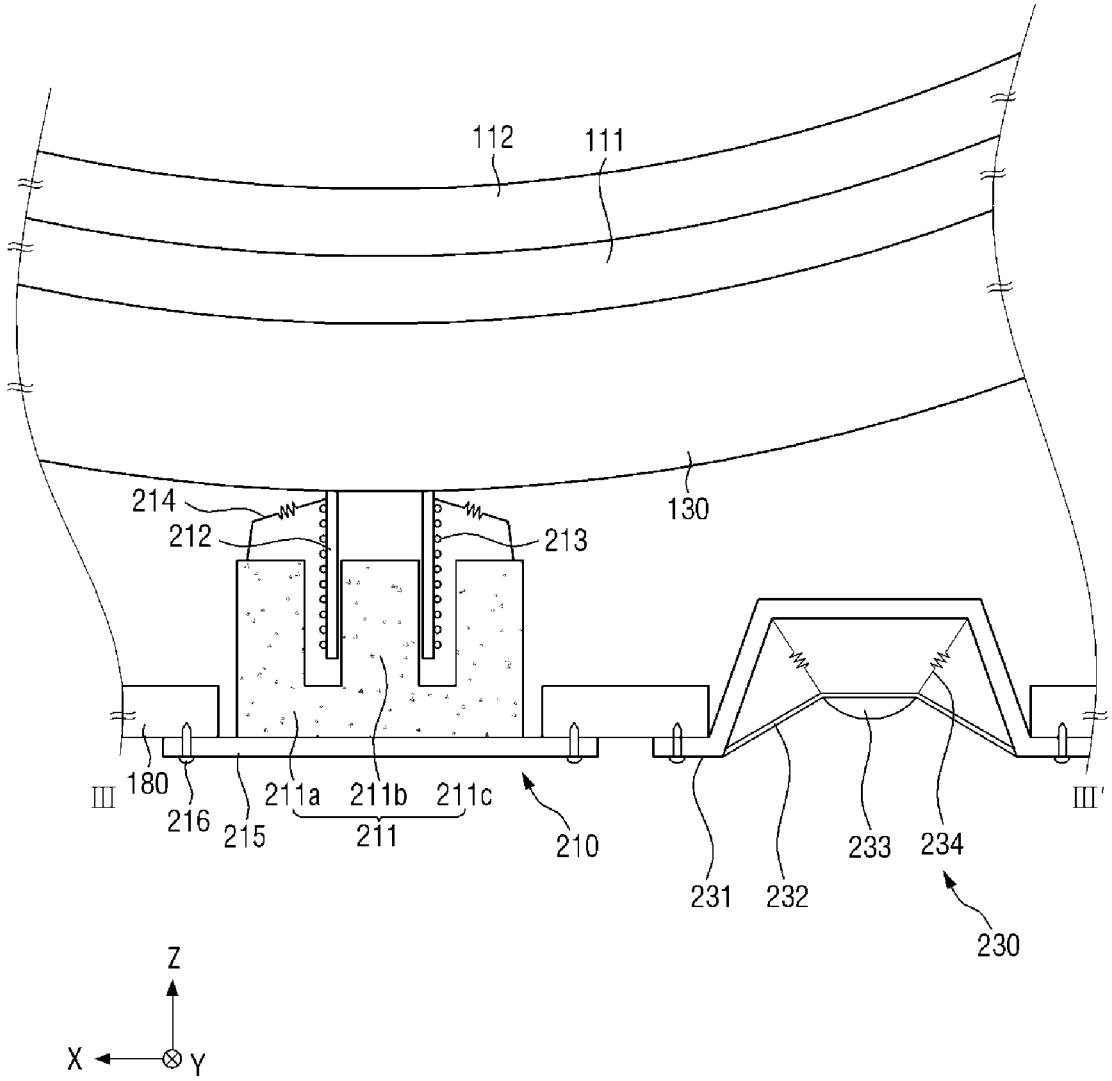

The voice coil 213 is wound on an outer circumferential surface of the bobbin 212. The voice coil 213 adjacent to the end of the bobbin 212 may receive the first sound signal. Therefore, an electric current may flow through the voice coil 213 according to the first sound signal, and an applied magnetic field may be formed around the voice coil 213 according to the electric current flowing through the voice coil 213. The N pole and the S pole of the applied magnetic field formed around the voice coil 213 may be changed according to the alternating current (AC) driving of the electric current flowing through the voice coil 213. Accordingly, an attractive force and a repulsive force alternately act on the magnet 211 and the voice coil 213. Therefore, the bobbin 212 on which the voice coil 213 is wound may reciprocate in the third direction (Z-axis direction) as illustrated in FIGS. 9 and 10. Accordingly, the display panel 110 and the heat dissipation film 130 may vibrate in the third direction (Z-axis direction), thereby outputting sound.

The first damper 214 is disposed between a portion of an upper side of the bobbin 212 and the sidewalls 211*c* of the magnet 211. The first damper 214 controls the up and down vibration of the bobbin 212 by contacting or relaxing according to the up and down motion of the bobbin 212. That is, since the first damper 214 is connected to the bobbin 212 and the sidewalls 211*c* of the magnet 211, the up and down motion of the bobbin 212 may be limited by a restoring force of the first damper 214. In one embodiment, for example, when the bobbin 212 vibrates above a predetermined height or vibrates below a predetermined height, it may be returned to its original position by the restoring force of the first damper 214.

The lower plate 215 may be disposed on a lower surface of the magnet 211. The lower plate 215 may be formed integrally with the magnet 211 or may be formed separately from the magnet 211. When the lower plate 215 is formed separately from the magnet 211, the magnet 211 may be attached to the lower plate 215 by an adhesive member such as a double-sided tape.

The lower plate 215 may be fixed to the lower cover 180 by fixing members 216 such as screws. Accordingly, the magnet 211 of the first sound generator 210 may be fixed to the lower cover 180.

Unlike the first sound generator 210, the second sound generator 230 does not include the magnet 211 and the voice coil 213. Therefore, the second sound generator 230 does not output sound in response to an applied voltage. In one embodiment, for example, the second sound generator 230 may output sound through a resonance phenomenon of a sound generator (e.g., the first sound generator 210) used together as illustrated in FIG. 8. To this end, the second sound generator 230 may include a frame portion 231, a diaphragm 232, a cover portion 233, and a second damper 234 as illustrated in FIG. 8.

The frame portion 231 may serve as a support member to which the diaphragm 232 and the second damper 234 are fixed. The frame portion 231 may be fixed to the lower cover 180 by fixing members 235 such as screws in order to stably serve as a support member. The frame portion 231 may include or be made of a solid and hard material such as a plastic or metal material.

Edges of the diaphragm 232 are fixed to edges of the frame portion 231. The diaphragm 232 may include or be made of various materials. In one embodiment, for example, the diaphragm 232 may include or be made of a material obtained by processing pulp or paper, ceramic, Kevlar, aluminum or magnesium or a combination (e.g., an alloy) thereof, a synthetic resin such as polypropylene, or a polyamide-based fiber. The diaphragm 232 may vibrate in the thickness direction of the diaphragm 232, that is, in the third direction (Z-axis direction) according to a pressure change in a space between the display panel 110 and the lower cover 180.

In an embodiment, as shown in FIG. 8, the diaphragm 232 may have a conical structure in FIG. 8, but not being limited thereto. Alternatively, the diaphragm 232 may be variously modified to be in one of various shapes. In one embodiment, for example, the diaphragm 232 may have a flat plate-like structure.

The second damper 234 may be connected to a bottom surface or part of sidewalls of the frame portion 231 and may be connected to the diaphragm 232. In such an embodiment, the second damper 234 controls the up and down vibration of the diaphragm 232 by contracting or relaxing according to the up and down motion of the diaphragm 232. That is, since the second damper 234 is connected to the diaphragm 232 and the bottom surface or sidewalls of the frame portion 231, the up and down motion of the diaphragm 232 may be limited by a restoring force of the second damper 234. In one embodiment, for example, when the diaphragm 232 vibrates above a predetermined height or vibrates below a predetermined height, the diaphragm 232 may be returned to its original position by the restoring force of the second damper 234.

The cover portion 233 may be disposed on the diaphragm 232 and prevent foreign matter from permeating into the second sound generator 230. The cover portion 233 may have a dome-shaped structure and located in a central portion of the diaphragm 232. In an alternative embodiment, a sealed structure is formed by the diaphragm 232, and the cover portion 233 may be omitted.

The diaphragm 232 may vibrate in the thickness direction of the diaphragm 232, that is, in the third direction (Z-axis direction) according to a pressure change in the space between the display panel 110 and the lower cover 180. In an embodiment, when the display panel 110 is expanded toward the second substrate 112 by the first sound generator 210 as illustrated in FIG. 9, the pressure in the space between the display panel 110 and the lower cover 180 decreases. In such an embodiment, the diaphragm 232 moves in the upward direction (that is, toward the inside of the lower cover 180) as illustrated in FIG. 9.

In an embodiment, when the display panel 110 is contracted toward the first substrate 111 by the first sound generator 210 as illustrated in FIG. 10, the pressure in the space between the display panel 110 and the lower cover 180 increases. In such an embodiment, the diaphragm 232 moves in a downward direction (that is, toward the outside of the lower cover 180) as illustrated in FIG. 10.

In an embodiment, as described above, when the first sound generator 210 outputs a first sound by vibrating the display panel 110, the diaphragm 232 of the second sound generator 230 may vibrate by itself without an applied voltage, thereby outputting a second sound in the low-frequency range. Since the second sound generator 230 is disposed in a hole formed in the lower cover 180, the quality of low-frequency sound may be improved without a change in the overall thickness of the display device 10.

In an embodiment, the first sound generator 210 and the second sound generator 230 are fixed to the lower cover 180 as illustrated, but embodiments are not limited thereto. Alternatively, the first sound generator 210 and the second sound generator 230 may be fixed to the control circuit board 160, the system circuit board, the power circuit board or a dummy circuit board, instead of the lower cover 180. The dummy circuit board refers to a circuit board on which circuits other than the first sound generator 210 or the second sound generator 230 are not disposed. The dummy circuit board may be a flexible printed circuit board or a printed circuit board.

Figure 12:
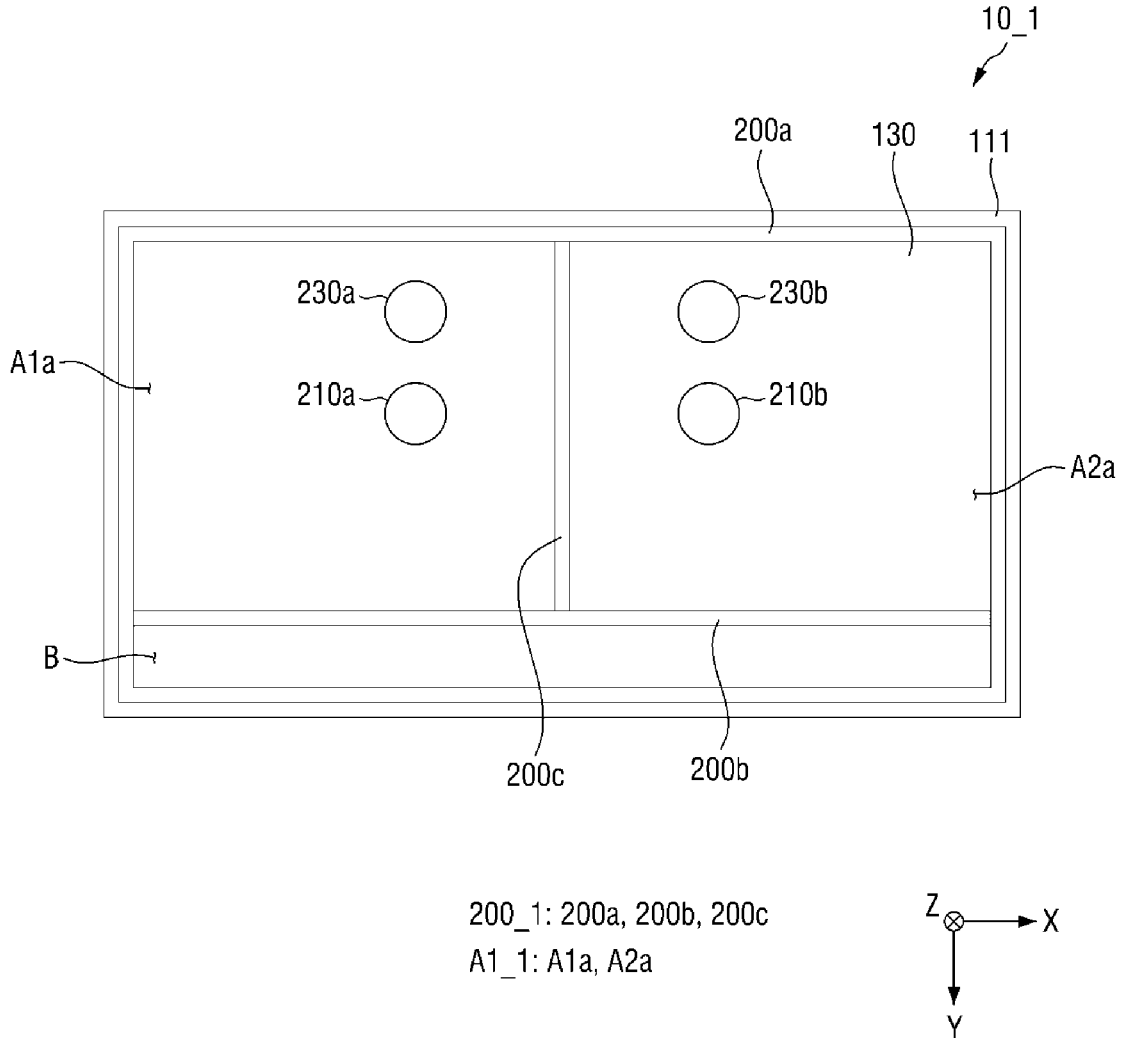
FIGS. 12 and 13 illustrate the arrangement of a blocking member and sound generators according to various embodiments.
Figure 13:
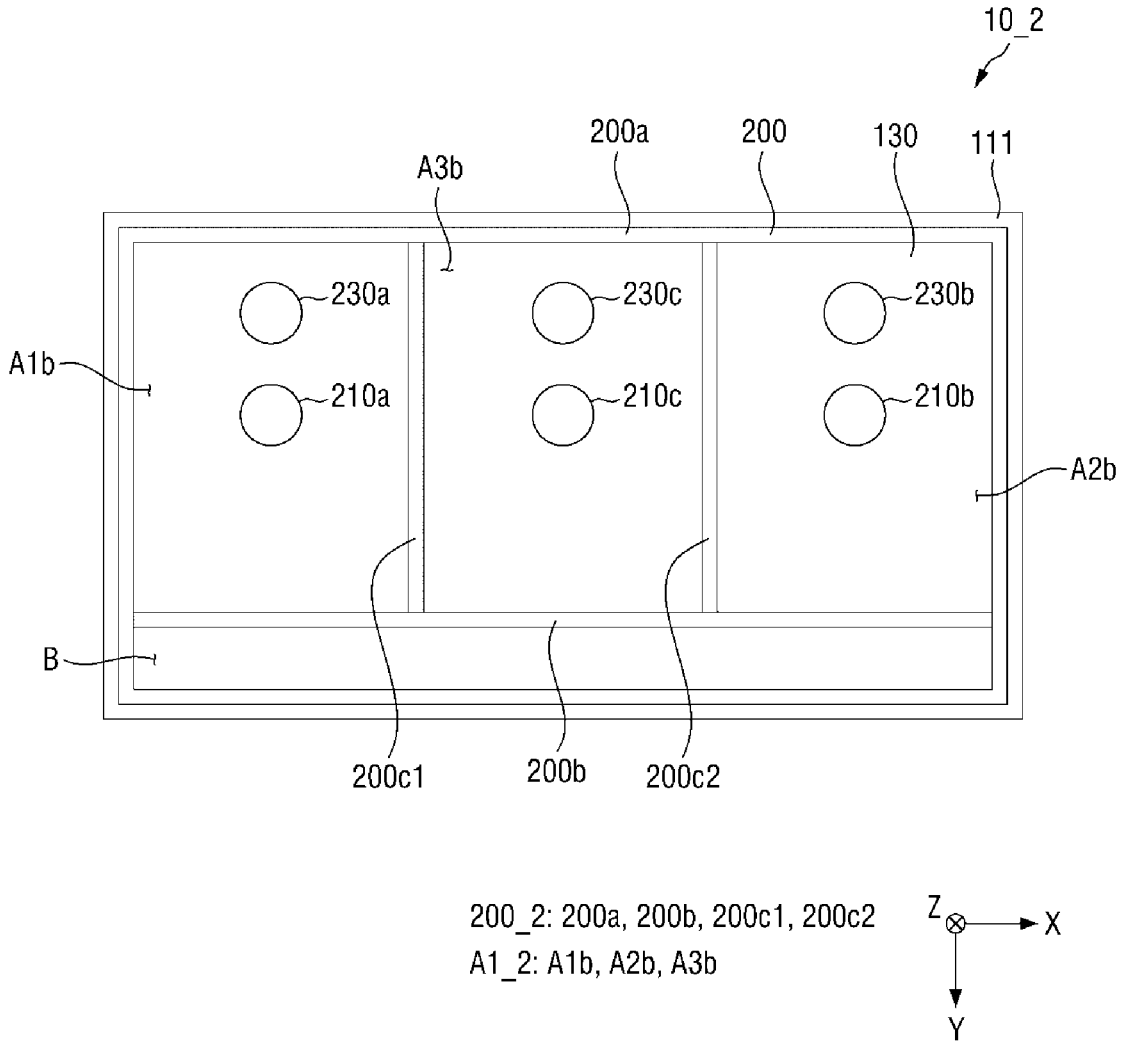

FIGS. 12 and 13 illustrate the arrangement of a blocking member and sound generators according to various embodiments. The embodiments of FIGS. 12 and 13 are substantially the same as the embodiment of FIG. 6 except that each of a first sound generator 210 and a second sound generator 230 includes a plurality of sound generators.

In an embodiment, referring to FIG. 12, a blocking member 200_1 may include a first portion 200*a*, a second portion 200*b*, and a third portion 200*c*.

The first portion 200*a* may define an air gap space between a heat dissipation film 130 and a lower cover 180, and the second portion 200*b* may divide the air gap space into a sound area A1_1 and a circuit area B. In such an embodiment, other elements or features are the same as or similar to those described above with reference to FIG. 6, and thus any repetitive detailed description thereof will be omitted.

The third portion 200*c* may divide the sound area A1_1 into a first sound area A1*a* and a second sound area A2*a* which are different from each other. Each of the first sound area A1*a* and the second sound area A2*a* may be completely sealed by the first portion 200*a*, the second portion 200*b*, and the third portion 200*c*.

A first sound generator (210*a* and 210*b*) may include a plurality of sound generators, specifically, may include a first first sound generator 210*a* disposed in the first sound area A1*a* and a second first sound generator 210*b* disposed in the second sound area A2*a*. In some embodiments, the first first sound generator 210*a* and the second first sound generator 210*b* may be exciters.

A second sound generator (230*a* and 230*b*) may also include a plurality of sound generators, specifically, may include a first second sound generator 230*a* disposed in the first sound area A1*a* and a second second sound generator 230*b* disposed in the second sound area A2*a*. In some embodiments, the first second sound generator 230*a* and the second second sound generator 230*b* may be passive radiators.

The first first sound generator 210*a* and the first second sound generator 230*a* may be disposed in the first sound generator A1*a*, and the second first sound generator 210*b* and the second second sound generator 230*b* may be disposed in the second sound area A2*a*.

In an embodiment, the first sound area A1*a* of a display device 10_1 may provide right stereo sound by the first first sound generator 210*a* and the first second sound generator 230*a*, and the second sound area A2*a* may provide left stereo sound by the second first sound generator 210*b* and the second second sound generator 230*b*. Therefore, the display device 10_1 may provide 2.0-channel stereo sound.

Since the sound area A1_1 is divided into the first sound area A1*a* and the second sound area A2*a* by the third portion 200*c*, it is possible to prevent the interference between sound or sound waves generated in the first sound area A1*a* and sound or sound waves generated in the second sound area A2*a*. In such an embodiment, since each of the first sound area A1*a* and the second sound area A2*a* forms a completely sealed space, a pressure change in the first sound area A1*a* and a pressure change in the second sound area A2*a* may be effectively transmitted to the second sound generator (230*a* and 230*b*).

In such an embodiment, since the first sound area A1*a* and the second sound area A2*a* are completely sealed, a reduction in sound pressure may be prevented, thereby improving sound output characteristics of the display device 10_1.

The circuit area B is an area where source circuit boards 140 are disposed. In such an embodiment, other elements or features are the same as or similar to those described above, and thus any repetitive detailed description thereof will be omitted. In an alternative embodiment, the circuit area B may be omitted.

In an alternative embodiment, referring to FIG. 13, a blocking member 200_2 may include a first portion 200*a*, a second portion 200*b*, a third portion 200*c*1, and a fourth portion 200*c*2.

The first portion 200*a* may define an air gap space between a heat dissipation film 130 and a lower cover 180, and the second portion 200*b* may divide the air gap space into a sound area A1_2 and a circuit area B. Other elements or features are the same as or similar to those described above with reference to FIG. 6, and thus any repetitive detailed description thereof will be omitted.

The third portion 200*c*1 and the fourth portion 200*c*2 may divide the sound area A1_2 into a first sound area A1*b*, a second sound area A2*b*, and a third sound area A3*b* which are different from each other. The first sound area A1*b* may be completely sealed by the first portion 200*a*, the second portion 200*b*, and the third portion 200*c*1. The second sound area A2*b* may be completely sealed by the first portion 200*a*, the second portion 200*b*, and the fourth portion 200*c*2. The third sound area A3*b* may be completely sealed by the first portion 200*a*, the second portion 200*b*, the third portion 200*c*1 and the fourth portion 200*c*2.

A first sound generator (210*a*, 210*b* and 210*c*) may include a plurality of sound generators, for example, a plurality of exciters. In an embodiment, the first sound generator (210*a*, 210*b* and 210*c*) may include a first first sound generator 210*a* disposed in the first sound area A1*b*, a second first sound generator 210*b* disposed in the second sound area A2*b*, and a third first sound generator 210*c* disposed in the third sound area A3*b*.

A second sound generator (230*a*, 230*b* and 230*c*) may include a plurality of sound generators, for example, a plurality of passive radiators. In an embodiment, the second sound generator (230*a*, 230*b* and 230*c*) may include a first second sound generator 230*a* disposed in the first sound area A1*b*, a second second sound generator 230*b* disposed in the second sound area A2*b*, and a third second sound generator 230*c* disposed in the third sound area A3*b*.

The first sound area A1*b*, the second sound area A2*b*, and the third sound area A3*b* may have the same size or different sizes. In one embodiment, for example, the first sound area A1*b* and the second sound area A2*b* may have the same size, and the size of the third sound area A3*b* may be smaller than the size of the first sound area A1*b* and the size of the second sound area A2*b*. However, the size of each sound area and the size relationship between the sound areas may be variously modified.

In an embodiment, where the first sound area A1*b*, the second sound area A2*b*, and the third sound area A3*b* are separated from each other, the first sound area A1*b* of a display device 10_2 may provide right stereo sound in a mid- to high-frequency range by the first first sound generator 210*a* and the first second sound generator 230*a*, the second sound area A2*b* may provide left stereo sound in the mid- to high-frequency range by the second first sound generator 210*b* and the second second sound generator 230*b*, and the third sound area A3*b* may be made to provide sound in a mid- to low-frequency range by the third first sound generator 210*c* and the third second sound generator 230*c*. Therefore, the display device 10_2 may provide 2.0-channel stereo sound.

According to an embodiment, since the sound area A1_2 is divided into the first sound area A1*b*, the second sound area A2*b* and the third sound area A3*b* by the third portion 200*c*1 and the fourth portion 200*c*2, it is possible to prevent the interference between sounds or sound waves generated in the sound areas. In such an embodiment, since each of the first sound area A1*b*, the second sound area A2*b* and the third sound area A3*b* is sealed, a reduction in sound pressure may be prevented, and rich sound output may be provided in all frequency ranges. In such an embodiment, since each of the first sound area A1*b*, the second sound area A2*b* and the third sound area A3*b* forms a completely sealed space, a pressure change in each space may be effectively transmitted to the second sound generator (230*a*, 230*b* and 230*c*). Accordingly, bass characteristics may be enhanced.

Figure 14:
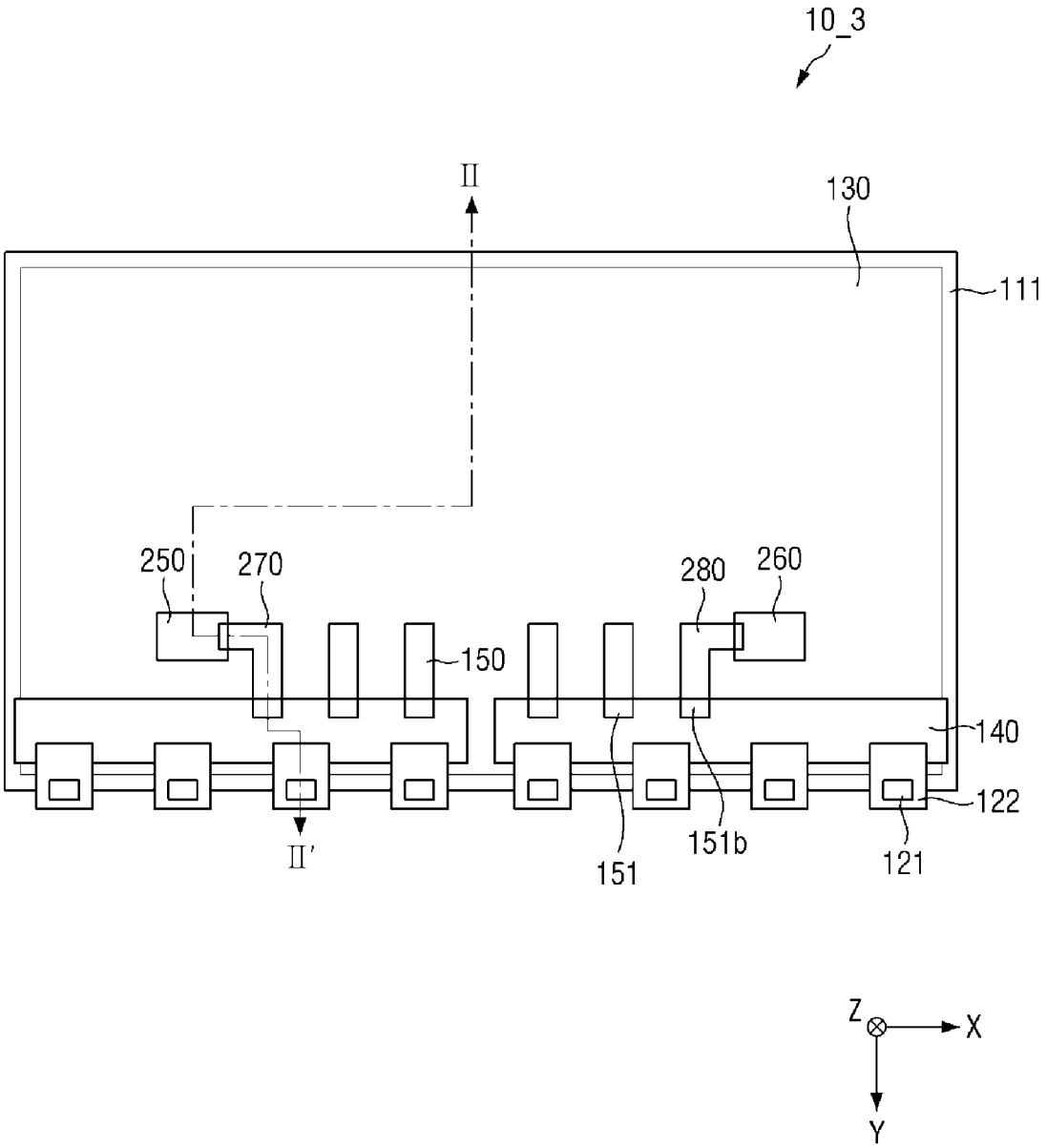
FIG. 14 is a bottom view of a display device according to an embodiment, excluding a lower cover and a control circuit board.
Figure 15:
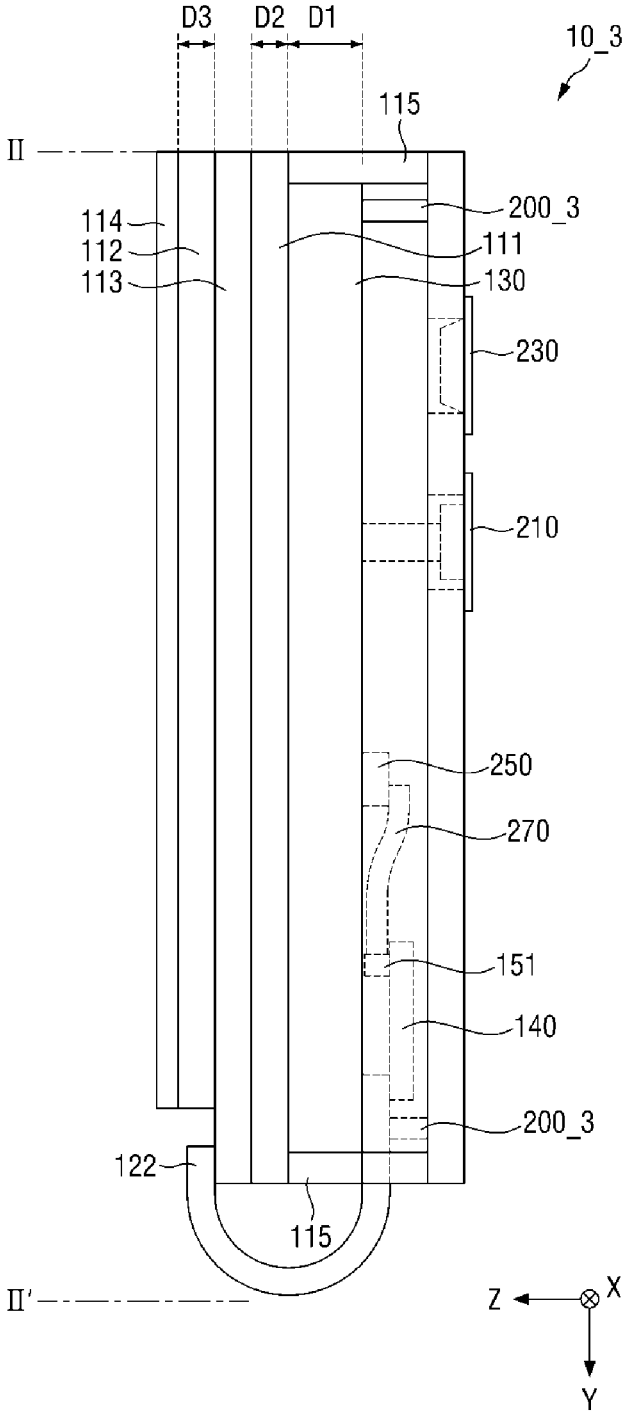
FIG. 15 is a cross-sectional view of the display device taken along line II-II' of FIGS. 3 and 14.
Figure 16:
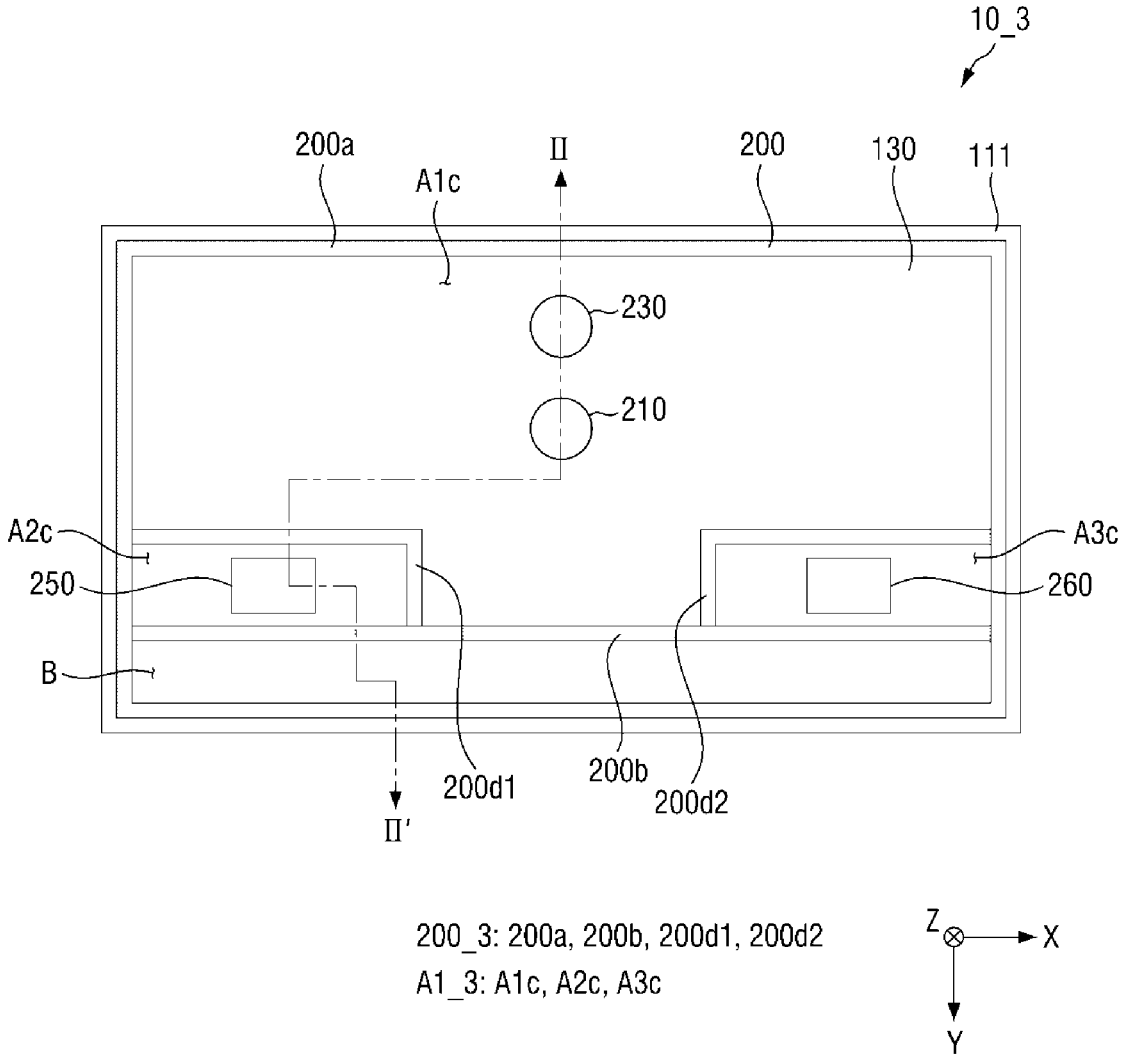
FIG. 16 is a bottom view illustrating a blocking member and sound generators of the display device of FIGS. 14 and 15.

FIG. 14 is a bottom view of a display device 10_3 according to an embodiment, excluding a lower cover 180 and a control circuit board 160. FIG. 15 is a cross-sectional view of the display device 10_3 taken along line II-II' of FIGS. 3 and 14. FIG. 16 is a bottom view illustrating a blocking member 200_3 and sound generators 210, 230, 250 and 260 of the display device 10_3 of FIGS. 14 and 15.

The embodiment of FIGS. 14 through 16 is substantially the same as the embodiment of FIGS. 3 through 5 except that a third sound generator 250 and a fourth sound generator 260 are further attached to a lower surface of a heat dissipation film 130, a first sound circuit board 270 and a second sound circuit board 280 are further provided to electrically connect the third sound generator 250 and the fourth sound generator 260 to source circuit boards 140, and the blocking member 200_3 is provided.

Referring to FIGS. 3 and 14 through 16, the third sound generator 250 and the fourth sound generator 260 may be attached onto a surface of the heat dissipation film 130 by an adhesive member such as a double-sided adhesive.

The third sound generator 250 may be connected to a second first connector 151*b* of a source circuit board 140 by the first sound circuit board 270, and the fourth sound generator 260 may be connected to a second first connector of a source circuit board 140 by the second sound circuit board 280.

A first pad and a second pad connected to a first electrode and a second electrode disposed on a surface of the third sound generator 250 may be disposed on a side of the first sound circuit board 270. A first pad and a second pad connected to a first electrode and a second electrode disposed on a surface of the fourth sound generator 260 may be disposed on a side of the second sound circuit board 280.

Connection portions for connection to the second first connectors 151*b* of the source circuit boards 140 may be disposed on the other side of the first sound circuit board 270 and the other side of the second sound circuit board 280. That is, the third sound generator 250 may be electrically connected to the source circuit board 140 by the first sound circuit board 270, and the fourth sound generator 260 may be electrically connected to the source circuit board 140 by the second sound circuit board 280.

In an embodiment, each of the first sound circuit board 270 and the second sound circuit board 280 may be a flexible printed circuit board or a flexible cable.

The third sound generator 250 may receive a third sound signal from a sound driving circuit 171. The third sound generator 250 may output sound by vibrating a display panel 110 according to the third sound signal.

The fourth sound generator 260 may receive a fourth sound signal from the sound driving circuit 171. The fourth sound generator 260 may output sound by vibrating the display panel 110 according to the fourth sound signal.

According to an embodiment, as illustrated in FIGS. 14 through 16, the third sound generator 250 and the source circuit board 140 are connected by the first sound circuit board 270, and the fourth sound generator 260 and the source circuit board 140 are connected by the second sound circuit board 280. Therefore, even if the third sound generator 250 and the fourth sound generator 260 are disposed on the surface of the heat dissipation film 130 and the control circuit board 160 is disposed on a surface of the lower cover 180, the control circuit board 160 and the third sound generator 250 may be easily electrically connected to each other, and the control circuit board 160 and the fourth sound generator 260 may be easily electrically connected to each other.

FIG. 16 is a bottom view illustrating the heat dissipation film 130, the blocking member 200_3 and the first through fourth sound generators 210, 230, 250 and 260 of the display device 10_3. For ease of description, only a first substrate 111 of the display panel 110, the heat dissipation film 130, the blocking member 200_3, the first through fourth sound generators 210, 230, 250 and 260 are illustrated in FIG. 16.

That is, source driving circuits 121, flexible films 122, the source circuit boards 140, cables 150, the control circuit board 160, a timing control circuit 170, and the lower cover 180 are omitted from FIG. 16.

Referring to FIG. 16, the blocking member 200_3 may include a first portion 200*a*, a second portion 200*b*, a third portion 200*d*1, and a fourth portion 200*d*2.

The first portion 200*a* may define an air gap space between the heat dissipation film 130 and the lower cover 180, and the second portion 200*b* may divide the air gap space into a sound area A1_3 and a circuit area B. Other elements or features are the same as or similar to those described above with reference to FIG. 6, and thus any repetitive detailed description thereof will be omitted.

The third portion 200*d*1 and the fourth portion 200*d*2 may divide the sound area A1_3 into a first sound area A1*c*, a second sound area A2*c*, and a third sound area A3*c* which are different from each other. In an embodiment, the second sound area A2*c* may be located at a corner of the sound area A1_3 adjacent to the circuit area B, and the third sound area A3*c* may be located at another corner of the sound area A1_3 adjacent to the circuit area B.

The first sound area A1*c* may be completely sealed by the first portion 200*a*, the second portion 200*b*, the third portion 200*d*1, and the fourth portion 200*d*2. The second sound area A2*c* may be completely sealed by the first portion 200*a*, the second portion 200*b*, and the third portion 200*d*1. The third sound area A3*c* may be completely sealed by the first portion 200*a*, the second portion 200*b*, and the fourth portion 200*d*2.

In an embodiment, as shown in FIG. 16, the first sound generator 210 and the second sound generator 230 may be disposed in the first sound area A1*c*.

In such an embodiment, the third sound generator 250 may be disposed in the second sound area A2*c*, and the fourth sound generator 260 may be disposed in the third sound area A3*c*.

In an embodiment, the second sound area A2*c* and the third sound area A3*c* may have substantially a same size as each other. In an embodiment, the respective sizes of the second sound area A2*c* and the third sound area A3*c* may be smaller than the size of the first sound area A1*c*.

The circuit area B is an area where the source circuit boards 140 are disposed. Other elements or features are the same as or similar to those described above, and thus any repetitive detailed description thereof will be omitted.

According to an embodiment, since the sound area A1_3 is divided into the first sound area A1*c*, the second sound area A2*c* and the third sound area A3*c* by the third portion 200*d*1 and the fourth portion 200*d*2, it is possible to prevent the interference between sounds or sound waves generated in the sound areas.

Figure 17:
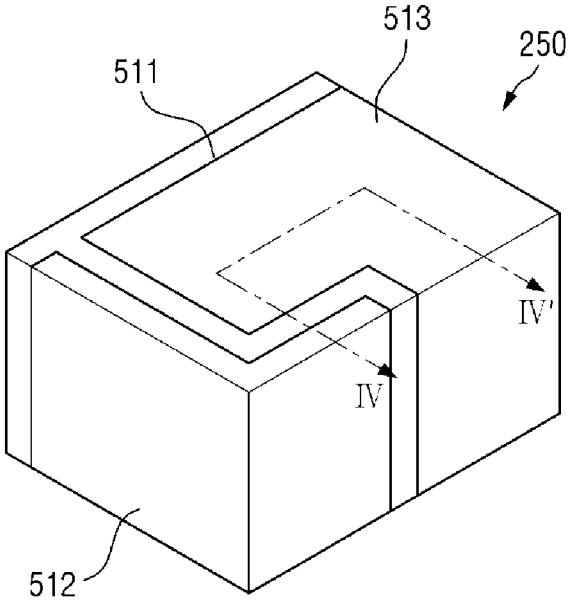
FIG. 17 is a perspective view of an embodiment of a fourth sound generator of FIGS. 14 and 15.
Figure 18:
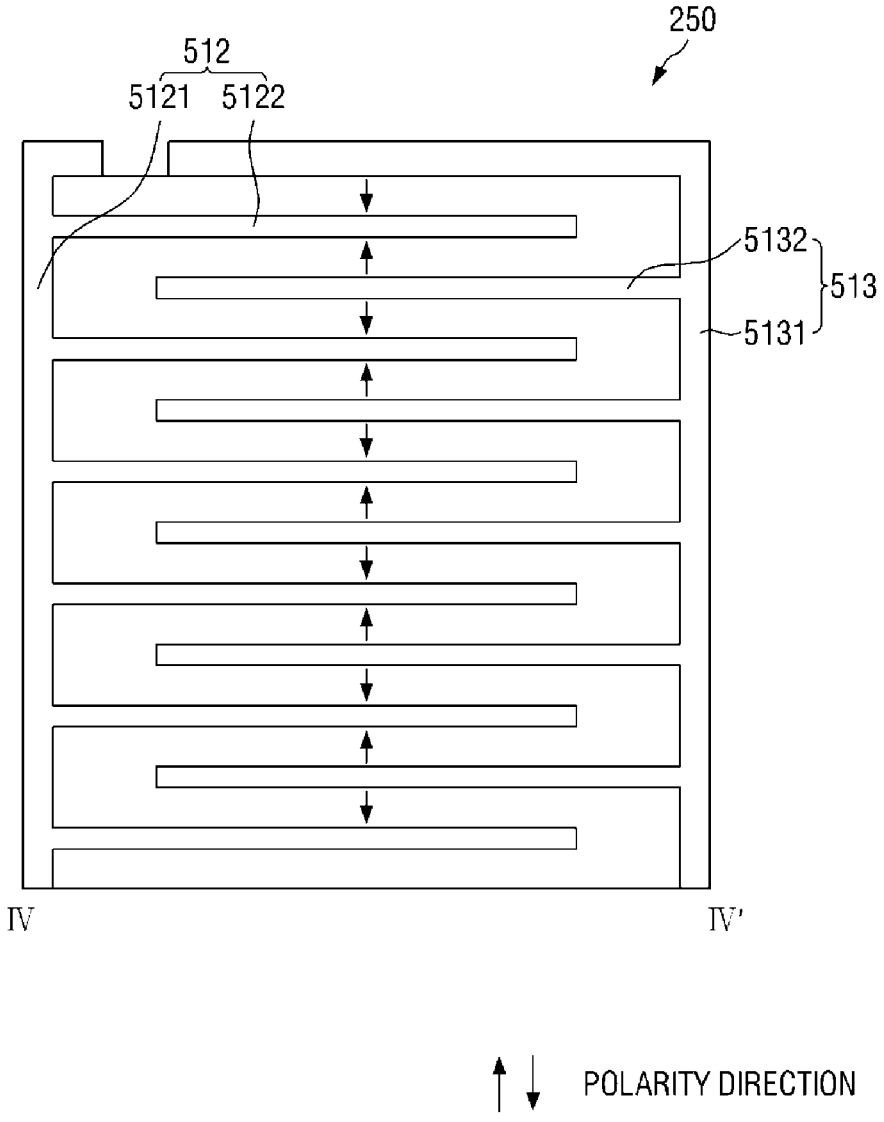
FIG. 18 is a cross-sectional view taken along line IV-IV' of FIG. 17.

FIG. 17 is a perspective view of an embodiment of the third sound generator 250 of FIGS. 14 and 15. FIG. 18 is a cross-sectional view taken along line IV-IV' of FIG. 17.

Referring to FIGS. 17 and 18, in an embodiment, each of the third sound generator 250 and the fourth sound generator may be a piezoelectric element that vibrates the display panel 110 by contracting or expanding according to an applied voltage. In such an embodiment, each of the third sound generator 250 and the fourth sound generator may include a vibration layer 511, a first electrode 512, and a second electrode 513.

The first electrode 512 may include a first stem electrode 5121 and first branch electrodes 5122. The first stem electrode 5121 may be disposed on only one side surface of the vibration layer 511 or on a plurality of side surfaces of the vibration layer 511 as illustrated in FIG. 17. The first stem electrode 5121 may also be disposed on an upper surface of the vibration layer 511. The first branch electrodes 5122 may branch from the first stem electrode 5121. The first branch electrodes 5122 may be arranged parallel to each other.

The second electrode 513 may include a second stem electrode 5131 and second branch electrodes 5132. In an embodiment, the second stem electrode 5131 may be disposed on another side surface of the vibration layer 511 or on a plurality of side surfaces of the vibration layer 511 as illustrated in FIG. 17. In such an embodiment, the first stem electrode 5121 may be disposed on any one of the side surfaces on which the second stem electrode 5131 is disposed, as illustrated in FIG. 17. The second stem electrode 5131 may be disposed on the upper surface of the vibration layer 511. The first stem electrode 5121 and the second stem electrode 5131 may not overlap each other. The second branch electrodes 5132 may branch from the second stem electrode 5131. The second branch electrodes 5132 may be arranged parallel to each other.

The first branch electrodes 5122 and the second branch electrodes 5132 may be arranged parallel to each other in the horizontal direction (X-axis direction or Y-axis direction). In such an embodiment, the first branch electrodes 5122 and the second branch electrodes 5132 may be alternately arranged in the vertical direction (Z-axis direction). That is, the first branch electrodes 5122 and the second branch electrodes 5132 may be repeatedly arranged in the vertical direction (Z-axis direction) in the order of the first branch electrode 5122, the second branch electrode 5132, the first branch electrode 5122, and the second branch electrode 5132.

The first electrode 512 and the second electrode 513 may be connected to metal lines or pad electrodes of the first sound circuit board 270 or the second sound circuit board 280. The metal lines or pad electrodes of the first sound circuit board 270 or the second sound circuit board 280 may be connected to the first electrode 512 and the second electrode 513 disposed on a surface of the third sound generator 250 or the fourth sound generator.

The vibration layer 511 may be a piezoelectric element that is deformed according to a first driving voltage applied to the first electrode 512 and a second driving voltage applied to the second electrode 513. In an embodiment, the vibration layer 511 may include at least one of a piezoelectric material, such as a polyvinylidene fluoride ("PVDF") film or plumbum ziconate titanate ("PZT"), and an electro-active polymer.

Since the production temperature of the vibration layer 511 is high, the first electrode 512 and the second electrode 513 may include or be made of silver (Ag) having a high melting point or an alloy of Ag acid palladium (Pd). In an embodiment, where the first electrode 512 and the second electrode 513 includes or are made of an alloy of Ag and Pd, the Ag content may be higher than the Pd content to raise melting points of the first electrode 512 and the second electrode 513.

The vibration layer 511 may be disposed between each pair of the first and second branch electrodes 5122 and 5132. The vibration layer 511 may contract or expand according to a difference between the first driving voltage applied to each first branch electrode 5122 and the second driving voltage applied to a corresponding second branch electrode 5132.

In an embodiment, as illustrated in FIG. 18, the polarity direction of the vibration layer 511 disposed between a first branch electrode 5122 and a second branch electrode 5132 disposed under the first branch electrode 5122 may be the upward direction (↑). In this case, the vibration layer 511 has a positive polarity in an upper area adjacent to the first branch electrode 5122 and a negative polarity in a lower area adjacent to the second branch electrode 5132. In such an embodiment, the polarity direction of the vibration layer 511 disposed between a second branch electrode 5132 and a first branch electrode 5122 disposed under the second branch electrode 5132 may be the downward direction (↓). In this case, the vibration layer 511 has a negative polarity in an upper area adjacent to the second branch electrode 5132 and a positive polarity in a lower area adjacent to the first branch electrode 5122. The polarity direction of the vibration layer 511 may be determined by a poling process of applying an electric field to the vibration layer 511 using a first branch electrode 5122 and a second branch electrode 5132.

Figure 19:
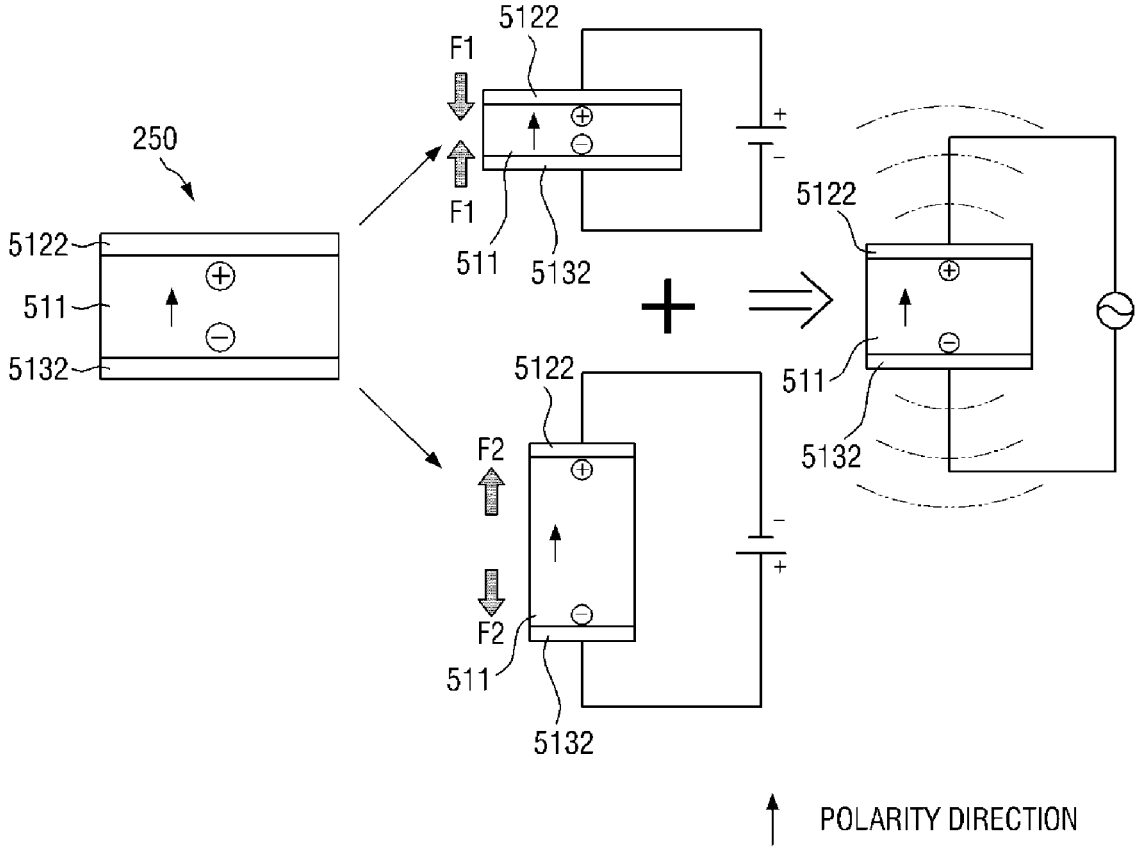
FIG. 19 illustrates a method of vibrating a vibration layer disposed between a first branch electrode and a second branch electrode of the fourth sound generator.
Figure 20:
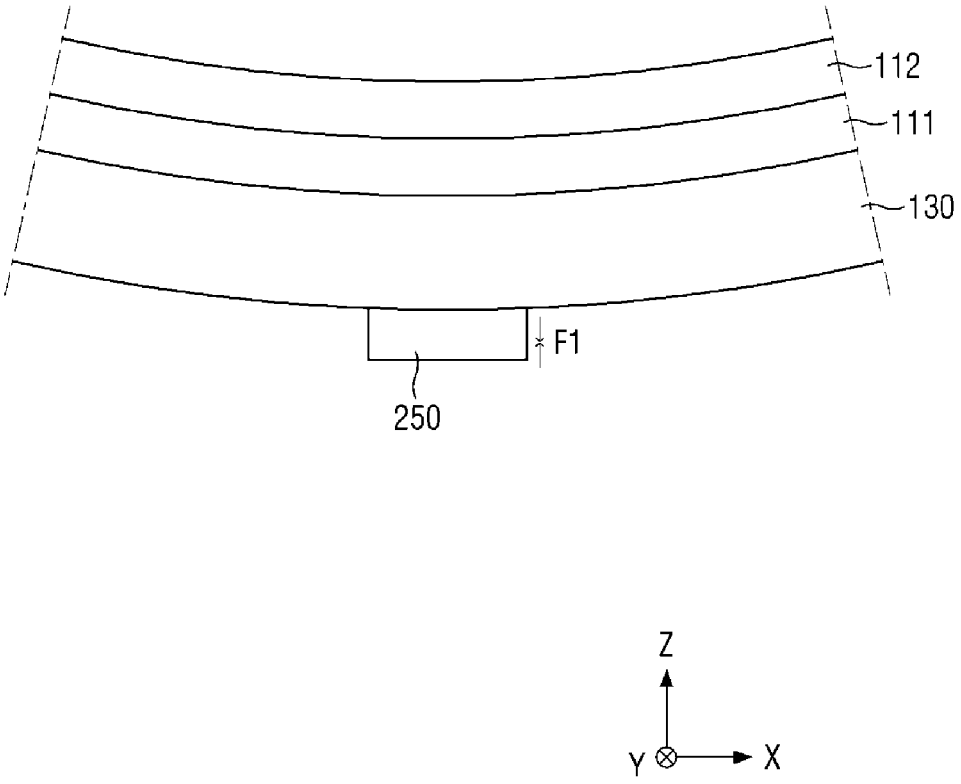
FIGS. 20 and 21 are side views illustrating the vibration of a display panel caused by the vibration of the fourth sound generator illustrated in FIGS. 17 and 18.
Figure 21:
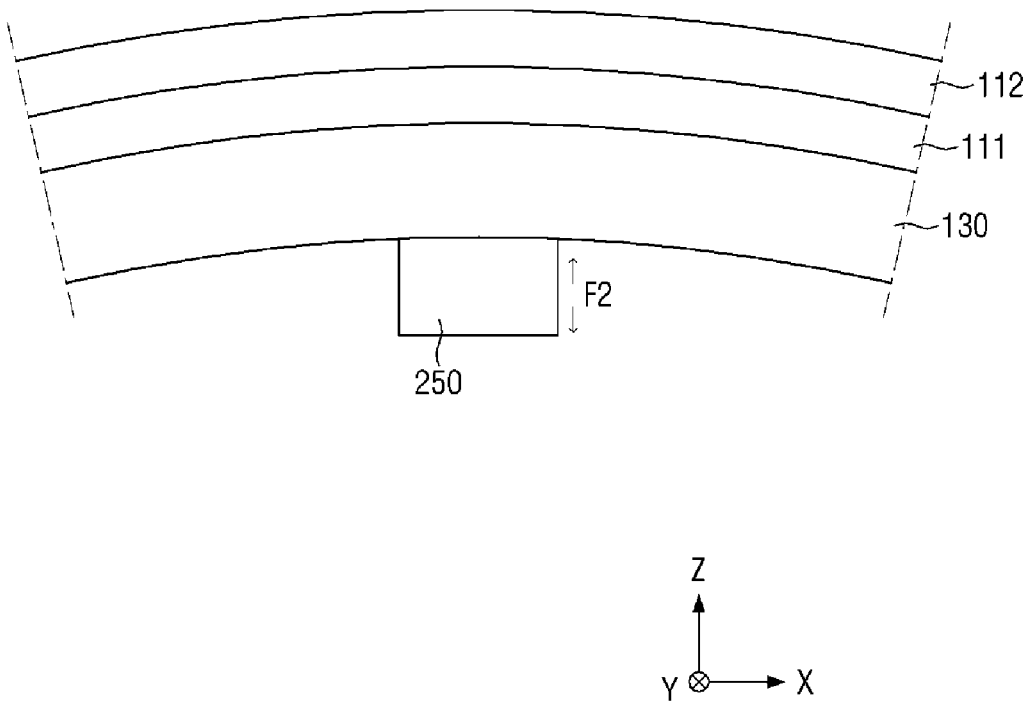

FIG. 19 illustrates a method of vibrating the vibration layer 511 disposed between a first branch electrode 5122 and a second branch electrode 5132 of the fourth sound generator 260. FIGS. 20 and 21 are side views illustrating the vibration of the display panel 110 caused by the vibration of the fourth sound generator 260 illustrated in FIGS. 17 and 18.

In an embodiment, when the polarity direction of the vibration layer 511 disposed between a first branch electrode 5122 and a second branch electrode 5132 disposed under the first branch electrode 5122 is the upward direction (↑) as illustrated in FIG. 19, if a driving voltage of the positive polarity is applied to the first branch electrode 5122 and a driving voltage of the negative polarity is applied to the second branch electrode 5132, the vibration layer 511 may contract according to a first force F1. The first force F1 may be a compressive force. In this case, if a driving voltage of the negative polarity is applied to the first branch electrode 5122 and a driving voltage of the positive polarity is applied to the second branch electrode 5132, the vibration layer 511 may expand according to a second force F2. The second force F2 may be a tensile force.

In such an embodiment, when the polarity direction of the vibration layer 511 disposed between a second branch electrode 5132 and a first branch electrode 5122 disposed under the second branch electrode 5132 is the downward direction (↓) as illustrated in FIG. 19, if a driving voltage of the positive polarity is applied to the second branch electrode 5132 and a driving voltage of the negative polarity is applied to the first branch electrode 5122, the vibration layer 511 may expand according to a tensile force. In this case, if a driving voltage of the negative polarity is applied to the second branch electrode 5132 and a driving voltage of the positive polarity is applied to the first branch electrode 5122, the vibration layer 511 may contract according to a compressive force. The second force F2 may be a tensile force.

According to an embodiment, as illustrated in FIGS. 20 and 21, when a driving voltage applied to the first electrode 512 and a driving voltage applied to the second electrode 513 repeatedly alternate between the positive polarity and the negative polarity, the vibration layer 511 may repeatedly contract and expand, thus causing the third sound generator 250 and the fourth sound generator 260 to vibrate.

Since each of the third sound generator 250 and the fourth sound generator 260 is disposed on a lower surface of the display panel 110, when the vibration layer 511 of each of the third sound generator 250 and the fourth sound generator 260 contracts and expands, the display panel 110 may vibrate up and down due to stress as illustrated in FIGS. 20 and 21. As the display panel 110 is vibrated by each of the third sound generator 250 and the fourth sound generator 260 in this way, the display device 10_3 may output sound.

The second sound generator 230 may be disposed in a same area as the first sound generator 210, but may be disposed in an area different from an area in which the third sound generator 250 and the fourth sound generator 260 are disposed.

In an embodiment, each of the third sound generator 250 and the fourth sound generator 250 may serve as a high-frequency sound generator that outputs sound in a high-frequency range, and the first sound generator 210 may serve as a low-frequency sound generator that outputs sound in a mid- to low-frequency range. That is, the vibration displacement of the third sound generator 250 and the fourth sound generator 260 may be smaller than the vibration displacement of the first sound generator 210.

In an embodiment, as described above, the second sound generator 230 outputs sound through the up and down motion of a diaphragm 232 (see FIG. 8) according to a change in the internal pressure of the display device 10_3. In such an embodiment, since a sufficient pressure change occurs in the first sound area A1*c* where the first sound generator 210 is disposed, the second sound generator 230 can output a sufficient amount of low-frequency sound. However, a sufficient change in internal pressure may not occur in the second sound area A2*c* and the third sound area A3*c* where the third sound generator 250 and the fourth sound generator 260 are disposed. Therefore, the second sound generator 230 may not effectively output a sufficient amount of low-frequency sound to enhance the sound quality of the display device 10_3. Accordingly, in such an embodiment, the second sound generator 230 may be disposed adjacent to the first sound generator 210 in the area where the first sound generator 210 is disposed.

In one embodiment, for example, the display devices 10_1 and 10_2 may include a plurality of first sound generators as illustrated in FIGS. 12 and 13, and a plurality of second sound generators may be disposed in an area where the first sound generators are disposed and may be disposed adjacent to the first sound generators.

Figure 22:
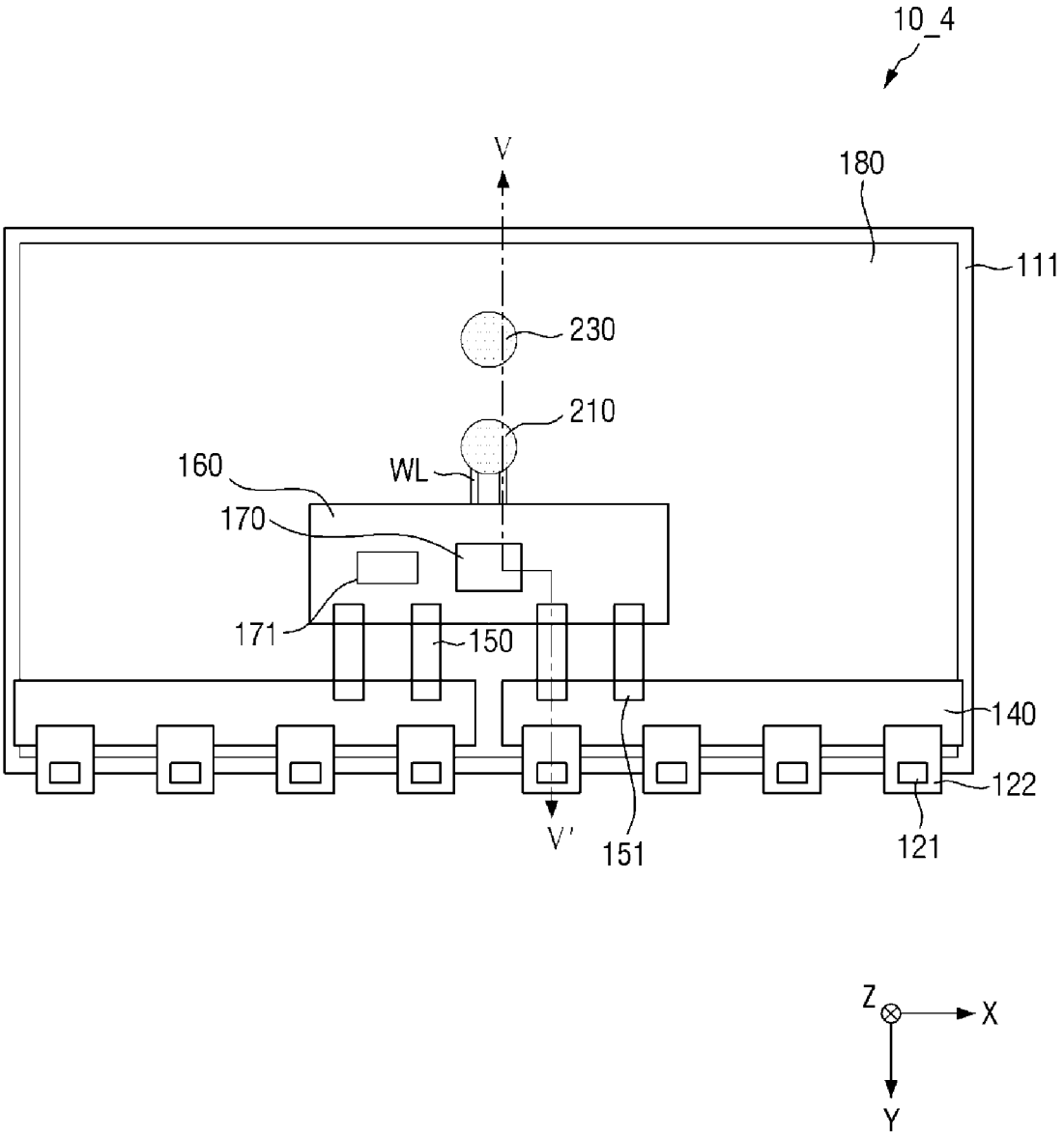
FIG. 22 is a bottom view of a display device according to an embodiment.
Figure 23:
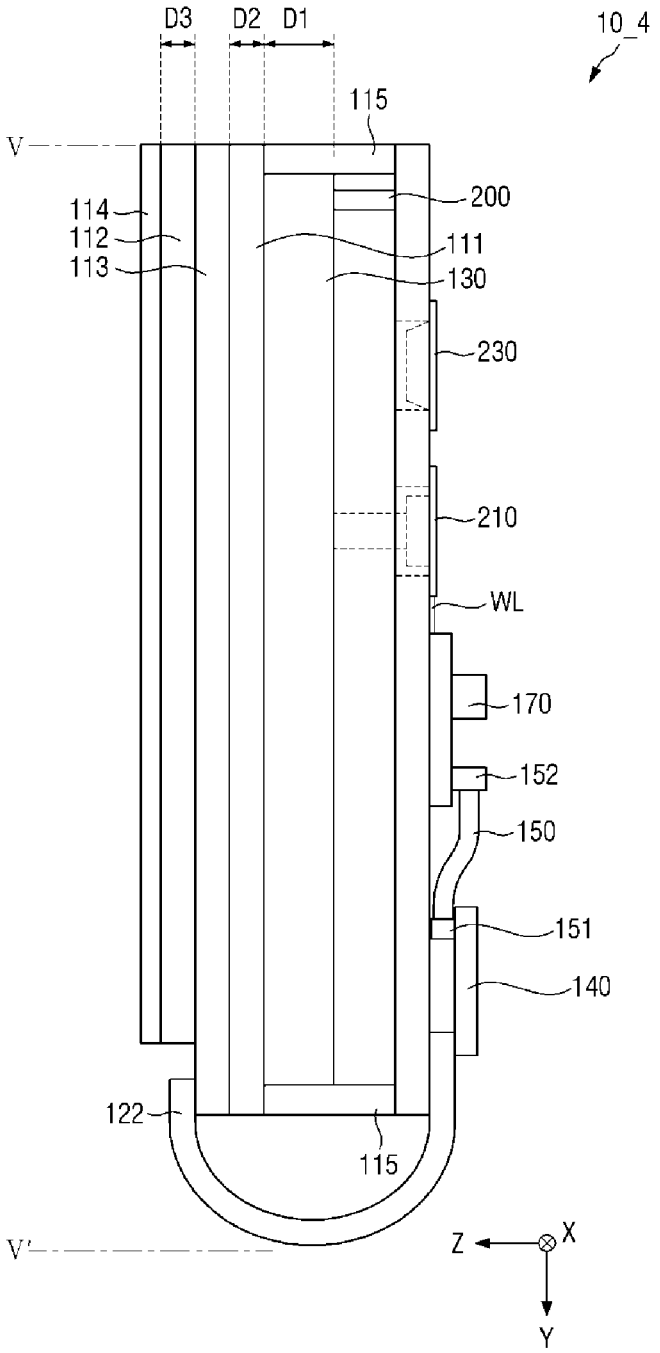
FIG. 23 is a cross-sectional view of the display device taken along line V-V' of FIG. 22.

FIG. 22 is a bottom view of a display device 10_4 according to an embodiment. FIG. 23 is a cross-sectional view of the display device 10_4 taken along line V-V' of FIG. 22.

The embodiment of FIGS. 22 and 23 is substantially the same as the embodiment of FIGS. 3 through 5 except that flexible films 122 are bent toward a lower surface of a lower cover 180, and source circuit boards 140 are disposed on the lower surface of the lower cover 180.

Referring to FIGS. 22 and 23, the flexible films 122 are bent toward the lower surface of the lower cover 180. Accordingly, the source circuit boards 140 and a control circuit board 160 may be disposed on the lower surface of the lower cover 180. Therefore, cables 150 for connecting the source circuit boards 140 and the control circuit board 160 may be directly connected to the source circuit boards 140 and the control circuit board 160 without the need to pass through first cable holes CH1 defined through the lower cover 180.

In embodiments of a display device according to the invention, a sound generator uses a display panel as a diaphragm to output sound. Thus, sound may be output forward from the display device, thereby improving sound quality. In such embodiments, the sound generator makes it possible to omit a speaker disposed on a lower surface or a side of a conventional display panel.

In embodiments of a display device according to the invention, a low-frequency sound generator which generates low-frequency sound without an applied voltage is attached to a surface of a lower cover. Therefore, it is possible to reinforce the low-frequency sound of the display device and improve the overall sound quality.

In embodiments of a display device according to the invention, a low-frequency sound generator is attached to a hole provided in a surface of a lower cover. Therefore, the sound quality of the display device may be improved without an increase in thickness.

The invention should not be construed as being limited to the exemplary embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel which comprises a first substrate and a light emitting element layer disposed on a first surface of the first substrate;

a lower cover disposed on a second surface of the first substrate;

a first sound generator disposed on the second surface of the first substrate, wherein the first sound generator outputs a first sound by vibrating the display panel using a magnetic force generated through a voice coil therein; and a second sound generator disposed on the second surface of the first substrate, wherein the second sound generator outputs a second sound corresponding to a pressure change in a space between the display panel and the lower cover caused by a vibration of the display panel.

2. The display device of claim 1, wherein a frequency range of the second sound is lower than a frequency range of the first sound.

3. The display device of claim 1, wherein the second sound generator comprises:

a diaphragm which vibrates in a thickness direction by the pressure change in the space between the display panel and the lower cover;

a damper which controls a vibration of the diaphragm in the thickness direction; and a frame portion to which the diaphragm and the damper are fixed.

4. The display device of claim 3, wherein the display panel further comprises a second substrate disposed on the light emitting element layer, and the diaphragm expands toward an inside of the lower cover when the display panel is expanded toward the second substrate by the first sound generator.

5. The display device of claim 3, wherein the diaphragm expands toward the outside of the lower cover when the display panel is contracted toward the first substrate by the first sound generator.

6. The display device of claim 3, wherein the first sound generator comprises:

a bobbin which is disposed on the second surface of the first substrate;

a first voice coil which surrounds the bobbin;

a first magnet disposed on the bobbin and spaced apart from the bobbin; and a lower plate disposed on the first magnet and fixed to the lower cover by a first fixing member.

7. The display device of claim 6, wherein the second sound generator further comprises a frame portion to which edges of the diaphragm are fixed, wherein the frame portion is fixed to the lower cover by a second fixing member.

8. The display device of claim 6, further comprising:

a third sound generator disposed on the second surface of the first substrate, wherein the third sound generator outputs a third sound by vibrating the display panel using a piezoelectric element, which contacts or expands based on a voltage applied thereto.

9. The display device of claim 8, wherein a frequency range of the third sound is higher than a frequency range of the first sound.

10. The display device of claim 8, further comprising:

a blocking member disposed between the first sound generator and the third sound generator.

11. The display device of claim 10, wherein the blocking member surrounds each of the first sound generator and the third sound generator.

12. The display device of claim 11, wherein the second sound generator is disposed in a first area where the first sound generator is surrounded by the blocking member.

13. The display device of claim 11, wherein the second sound generator is disposed in an area different from a second area where the third sound generator is surrounded by the blocking member.

14. The display device of claim 8, wherein the third sound generator comprises:

a first electrode to which a first driving voltage is applied;

a second electrode to which a second driving voltage is applied; and a vibration layer which is disposed between the first electrode and the second electrode, wherein the vibration layer contracts or expands based on the first driving voltage applied to the first electrode and the second driving voltage applied to the second electrode.

15. The display device of claim 1, further comprising:

a sound driving circuit which outputs a first sound signal including a plurality of driving voltages to the first sound generator.

16. The display device of claim 15, wherein the sound driving circuit is not electrically connected to the second sound generator.

17. The display device of claim 15, further comprising:

a circuit board disposed on the lower cover, wherein the sound driving circuit is disposed on the circuit board.

18. The display device of claim 17, further comprising:

a timing control circuit disposed on the circuit board, wherein the timing control circuit controls a driving timing of the display panel.

19. The display device of claim 8, further comprising:

a heat dissipation film attached onto a surface of the display panel, wherein the bobbin of the first sound generator is attached onto a surface of the heat dissipation film.

20. The display device of claim 19, wherein the third sound generator is attached onto the surface of the heat dissipation film.

* * * * *